US011067231B2

(12) United States Patent
Lotfi et al.

(10) Patent No.: US 11,067,231 B2
(45) Date of Patent: Jul. 20, 2021

(54) ALTERNATE JUNCTION BOX AND ARRANGEMENT FOR LIGHTING APPARATUS

(71) Applicant: DMF Inc., Carson, CA (US)

(72) Inventors: Amir Lotfi, Redondo Beach, CA (US); Michael D. Danesh, Carson, CA (US)

(73) Assignee: DMF, Inc., Carson, CA (US)

( * ) Notice: Subject to any disclaimer, the term of this patent is extended or adjusted under 35 U.S.C. 154(b) by 0 days.

(21) Appl. No.: 15/688,266

(22) Filed: Aug. 28, 2017

(65) Prior Publication Data

US 2019/0063701 A1 Feb. 28, 2019

(51) Int. Cl.

| | |
|---|---|
| ***F21S 8/02*** | (2006.01) |
| ***F21V 17/12*** | (2006.01) |
| ***F21V 23/06*** | (2006.01) |
| ***F21V 23/00*** | (2015.01) |
| ***F21V 23/04*** | (2006.01) |
| ***F21V 17/02*** | (2006.01) |
| ***F21S 9/02*** | (2006.01) |
| ***F21V 21/04*** | (2006.01) |
| ***F21V 23/02*** | (2006.01) |
| *F21Y 115/10* | (2016.01) |

(52) U.S. Cl.

CPC ..... *F21S 8/026* (2013.01); *F21S 9/022* (2013.01); *F21V 17/02* (2013.01); *F21V 17/12* (2013.01); *F21V 21/04* (2013.01); *F21V 23/003* (2013.01); *F21V 23/026* (2013.01); *F21V 23/04* (2013.01); *F21V 23/06* (2013.01); *F21Y 2115/10* (2016.08)

(58) Field of Classification Search

CPC ..... F21S 8/026

USPC ..... 362/191

See application file for complete search history.

(56) References Cited

U.S. PATENT DOCUMENTS

| | | | |
|---|---|---|---|
| 1,133,535 | A | 3/1915 | Cain et al. |
| 1,471,340 | A | 10/1923 | Knight |
| 1,856,356 | A | 5/1932 | Owen |
| 2,038,784 | A | 4/1936 | Ghadiali |
| 2,179,161 | A | 11/1939 | Rambusch |
| 2,197,737 | A | 4/1940 | Appleton |
| 2,352,913 | A | 7/1944 | Morrill |

(Continued)

FOREIGN PATENT DOCUMENTS

| | | |
|---|---|---|
| CA | 2243934 C | 6/2002 |
| CA | 2502637 A1 | 9/2005 |

(Continued)

OTHER PUBLICATIONS

U.S. Appl. No. 15/637,742, filed Jun. 29, 2017 Kopitzke, IV.

(Continued)

*Primary Examiner* — Rafferty D Kelly
(74) *Attorney, Agent, or Firm* — Smith Baluch LLP

(57) ABSTRACT

Embodiments are directed to a lighting system including a junction box for accommodating a light source assembly, and which is configured to allows for additional components such as separate drivers or emergency ballasts to also be included in the lighting system together with the light source assembly. In embodiments, the junction box is mounted on a pan style frame. In some embodiments, the lighting system includes a test switch mounted on a trim piece that is accessible from below a ceiling in which the lighting system is installed, and which allows for an emergency power supply to be verified.

30 Claims, 7 Drawing Sheets

(56) References Cited

U.S. PATENT DOCUMENTS

| | | | |
|---|---|---|---|
| 2,528,989 | A | 11/1950 | Ammells |
| 2,597,595 | A | 5/1952 | Ordas |
| 2,642,246 | A | 6/1953 | Larry |
| 2,670,919 | A | 3/1954 | Vincent |
| 2,697,535 | A | 12/1954 | Olson |
| 2,758,810 | A | 8/1956 | Good |
| D180,844 | S | 8/1957 | Poliakoff |
| 2,802,933 | A | 8/1957 | Harry |
| 2,998,512 | A | 8/1961 | Duchene et al. |
| 3,023,920 | A | 3/1962 | Cook et al. |
| 3,057,993 | A | 10/1962 | Gellert |
| 3,104,087 | A | 9/1963 | Joseph et al. |
| 3,214,126 | A | 10/1965 | Roos |
| 3,422,261 | A | 1/1969 | McGinty |
| 3,460,299 | A | 8/1969 | Wilson |
| 3,650,046 | A | 3/1972 | Skinner |
| 3,675,807 | A | 7/1972 | Lund et al. |
| 3,700,885 | A | 10/1972 | Bobrick |
| 3,711,053 | A | 1/1973 | Drake |
| D227,989 | S | 7/1973 | Geisel |
| 3,773,968 | A | 11/1973 | Copp |
| 3,812,342 | A | 5/1974 | McNamara |
| 3,836,766 | A | 9/1974 | Auerbach |
| 3,874,035 | A | 4/1975 | Schuplin |
| 3,913,773 | A | 10/1975 | Copp et al. |
| D245,905 | S | 9/1977 | Taylor |
| 4,088,827 | A | 5/1978 | Kohaut |
| 4,176,758 | A | 12/1979 | Glick |
| 4,280,169 | A | 7/1981 | Allen |
| 4,399,497 | A | 8/1983 | Druffel |
| 4,450,512 | A | 5/1984 | Kristofek |
| 4,460,948 | A | 7/1984 | Malola |
| 4,520,435 | A | 5/1985 | Baldwin |
| 4,539,629 | A | 9/1985 | Poppenheimer |
| 4,601,145 | A | 7/1986 | Wilcox |
| 4,667,840 | A | 5/1987 | Lindsey |
| 4,723,747 | A | 2/1988 | Karp et al. |
| 4,729,080 | A | 3/1988 | Fremont et al. |
| 4,754,377 | A | 6/1988 | Wenman |
| 4,770,311 | A | 9/1988 | Wang |
| 4,880,128 | A | 11/1989 | Jorgensen |
| 4,910,651 | A | 3/1990 | Montanez |
| 4,919,292 | A | 4/1990 | Hsu |
| 4,929,187 | A | 5/1990 | Hudson et al. |
| 4,930,054 | A | 5/1990 | Krebs |
| 5,044,582 | A | 9/1991 | Walters |
| D326,537 | S | 5/1992 | Gattari |
| 5,216,203 | A | 6/1993 | Gower |
| 5,222,800 | A | 6/1993 | Chan et al. |
| 5,239,132 | A | 8/1993 | Bartow |
| 5,250,269 | A | 10/1993 | Langer et al. |
| 5,266,050 | A | 11/1993 | O'Neil et al. |
| 5,303,894 | A | 4/1994 | Deschamps et al. |
| 5,382,752 | A | 1/1995 | Reyhan et al. |
| 5,420,376 | A | 5/1995 | Rajecki et al. |
| 5,465,199 | A | 11/1995 | Bray et al. |
| 5,505,419 | A | 4/1996 | Gabrius |
| 5,544,870 | A | 8/1996 | Kelly et al. |
| 5,562,343 | A | 10/1996 | Chan et al. |
| 5,571,993 | A | 11/1996 | Jones et al. |
| 5,580,158 | A | 12/1996 | Aubrey et al. |
| 5,588,737 | A | 12/1996 | Kusmer |
| 5,603,424 | A | 2/1997 | Bordwell et al. |
| 5,609,408 | A | 3/1997 | Targetti |
| 5,613,338 | A | 3/1997 | Esposito |
| D381,111 | S | 7/1997 | Lecluze |
| 5,662,413 | A | 9/1997 | Akiyama et al. |
| D386,277 | S | 11/1997 | Lecluze |
| 5,690,423 | A | 11/1997 | Hentz et al. |
| D387,466 | S | 12/1997 | Lecluze |
| 5,738,436 | A | 4/1998 | Cummings et al. |
| 5,836,678 | A | 11/1998 | Wright et al. |
| 5,942,726 | A | 8/1999 | Reiker |
| 5,944,412 | A | 9/1999 | Janos et al. |
| 5,957,573 | A | 9/1999 | Wedekind et al. |
| 6,082,878 | A | 7/2000 | Doubek et al. |
| 6,095,669 | A | 8/2000 | Cho |
| 6,098,945 | A | 8/2000 | Korcz |
| 6,105,334 | A | 8/2000 | Monson et al. |
| 6,161,910 | A | 12/2000 | Reisenauer et al. |
| 6,170,685 | B1 | 1/2001 | Currier |
| 6,174,076 | B1 | 1/2001 | Petrakis et al. |
| 6,176,599 | B1 | 1/2001 | Farzen |
| 6,267,491 | B1 | 7/2001 | Parrigin |
| 6,332,597 | B1 | 12/2001 | Korcz et al. |
| 6,350,043 | B1 | 2/2002 | Gloisten |
| 6,350,046 | B1 | 2/2002 | Lau |
| 6,364,511 | B1 | 4/2002 | Cohen |
| 6,375,338 | B1 | 4/2002 | Cummings et al. |
| 6,402,112 | B1 | 6/2002 | Thomas et al. |
| D461,455 | S | 8/2002 | Forbes |
| 6,461,016 | B1 | 10/2002 | Jamison et al. |
| 6,474,846 | B1 | 11/2002 | Kelmelis et al. |
| 6,491,413 | B1 | 12/2002 | Benesohn |
| D468,697 | S | 1/2003 | Straub, Jr. |
| D470,970 | S | 2/2003 | Huang |
| 6,515,313 | B1 | 2/2003 | Ibbetson et al. |
| 6,521,833 | B1 | 2/2003 | DeFreitas |
| D471,657 | S | 3/2003 | Huang |
| 6,583,573 | B2 | 6/2003 | Bierman |
| 6,585,389 | B2 | 7/2003 | Bonazzi |
| 6,600,175 | B1 | 7/2003 | Baretz et al. |
| D478,872 | S | 8/2003 | Heggem |
| 6,632,006 | B1 | 10/2003 | Rippel et al. |
| 6,657,236 | B1 | 12/2003 | Thibeault et al. |
| 6,666,419 | B1 | 12/2003 | Vrame |
| D488,583 | S | 4/2004 | Benghozi |
| 6,719,438 | B2 | 4/2004 | Sevack et al. |
| 6,758,578 | B1 | 7/2004 | Chou |
| 6,777,615 | B1 | 8/2004 | Gretz |
| 6,779,908 | B1 | 8/2004 | Ng |
| 6,827,229 | B2 | 12/2004 | Dinh et al. |
| 6,838,618 | B2 | 1/2005 | Newbold et al. |
| 6,906,352 | B2 | 6/2005 | Edmond et al. |
| D509,314 | S | 9/2005 | Rashidi |
| 6,948,829 | B2 | 9/2005 | Verdes et al. |
| 6,958,497 | B2 | 10/2005 | Emerson et al. |
| 6,964,501 | B2 | 11/2005 | Ryan |
| 6,967,284 | B1 | 11/2005 | Gretz |
| D516,235 | S | 2/2006 | Rashidi |
| 7,025,477 | B2 | 4/2006 | Blessing |
| 7,064,269 | B2 | 6/2006 | Smith |
| D528,673 | S | 9/2006 | Maxik et al. |
| 7,102,172 | B2 | 9/2006 | Lynch |
| D531,740 | S | 11/2006 | Maxik |
| D532,532 | S | 11/2006 | Maxik |
| 7,148,420 | B1 | 12/2006 | Johnson et al. |
| 7,148,632 | B2 | 12/2006 | Berman et al. |
| 7,154,040 | B1 | 12/2006 | Tompkins |
| 7,170,015 | B1 | 1/2007 | Roesch et al. |
| D536,349 | S | 2/2007 | Humber et al. |
| D537,039 | S | 2/2007 | Pincek |
| D539,229 | S | 3/2007 | Murphey |
| 7,186,008 | B2 | 3/2007 | Patti |
| 7,190,126 | B1 | 3/2007 | Paton |
| 7,211,833 | B2 | 5/2007 | Slater, Jr. et al. |
| 7,213,940 | B1 | 5/2007 | Van De Ven et al. |
| 7,234,674 | B2 | 6/2007 | Rippel et al. |
| D547,889 | S | 7/2007 | Huang |
| D552,969 | S | 10/2007 | Bobrowski et al. |
| D553,267 | S | 10/2007 | Yuen |
| D555,106 | S | 11/2007 | Pape et al. |
| D556,144 | S | 11/2007 | Dinh |
| 7,297,870 | B1 | 11/2007 | Sartini |
| 7,312,474 | B2 | 12/2007 | Emerson et al. |
| 7,320,536 | B2 | 1/2008 | Petrakis et al. |
| D561,372 | S | 2/2008 | Yan |
| D561,373 | S | 2/2008 | Yan |
| 7,335,920 | B2 | 2/2008 | Denbaars et al. |
| D563,896 | S | 3/2008 | Greenslate |
| 7,347,580 | B2 | 3/2008 | Blackman et al. |
| D570,012 | S | 5/2008 | Huang |
| 7,374,308 | B2 | 5/2008 | Sevack et al. |
| D570,504 | S | 6/2008 | Maxik et al. |

(56) References Cited

U.S. PATENT DOCUMENTS

D570,505 S 6/2008 Maxik et al.
7,399,104 B2 7/2008 Rappaport
7,429,025 B1 9/2008 Gretz
D578,677 S 10/2008 Huang
7,431,482 B1 * 10/2008 Morgan ..... F21S 8/02 362/364
7,432,440 B2 10/2008 Hull et al.
7,442,883 B2 10/2008 Jolly et al.
7,446,345 B2 11/2008 Emerson et al.
7,470,048 B2 12/2008 Wu
7,473,005 B2 1/2009 O'Brien
7,488,097 B2 2/2009 Reisenauer et al.
7,488,098 B2 2/2009 Dumont
7,494,258 B2 2/2009 McNaught
7,503,145 B2 3/2009 Newbold et al.
7,524,089 B2 4/2009 Park
D591,894 S 5/2009 Flank
7,534,989 B2 5/2009 Suehara et al.
D596,154 S 7/2009 Rivkin
7,566,154 B2 7/2009 Gloisten et al.
D599,040 S 8/2009 Alexander et al.
D600,836 S 9/2009 Hanley et al.
7,588,359 B2 9/2009 Coushaine et al.
7,592,583 B2 9/2009 Page et al.
D606,696 S 12/2009 Chen et al.
7,625,105 B1 12/2009 Johnson
7,628,513 B2 12/2009 Chiu
7,651,238 B2 1/2010 O'Brien
7,654,705 B2 2/2010 Czech et al.
D611,650 S 3/2010 Broekhoff
7,670,021 B2 3/2010 Chou
7,673,841 B2 3/2010 Wronski
7,677,766 B2 3/2010 Boyer
7,692,182 B2 4/2010 Bergmann et al.
7,704,763 B2 4/2010 Fujii et al.
D616,118 S 5/2010 Thomas et al.
7,722,208 B1 5/2010 Dupre et al.
7,722,227 B2 5/2010 Zhang et al.
7,735,795 B2 6/2010 Wronski
7,735,798 B2 6/2010 Kojima
7,748,887 B2 7/2010 Zampini, II et al.
7,766,518 B2 8/2010 Piepgras et al.
7,769,192 B2 8/2010 Takagi et al.
7,771,082 B2 8/2010 Peng
7,771,094 B2 8/2010 Goode
7,784,754 B2 8/2010 Nevers et al.
D624,691 S 9/2010 Zhang et al.
D624,692 S 9/2010 Mackin et al.
D625,847 S 10/2010 Maglica
D625,876 S 10/2010 Chen et al.
D627,507 S 11/2010 Lai et al.
D627,727 S 11/2010 Alexander et al.
7,828,465 B2 11/2010 Roberge et al.
D629,366 S 12/2010 Ericson et al.
7,845,393 B2 12/2010 Kao et al.
7,857,275 B2 12/2010 de la Borbolla
7,871,184 B2 1/2011 Peng
7,874,539 B2 1/2011 Wright et al.
7,874,703 B2 1/2011 Shastry et al.
7,874,709 B1 1/2011 Beadle
D633,224 S 2/2011 Lee
7,909,487 B1 3/2011 Venetucci et al.
D636,903 S 4/2011 Torenbeek
D637,339 S 5/2011 Hasan et al.
D637,340 S 5/2011 Hasan et al.
7,950,832 B2 5/2011 Tanaka et al.
D639,499 S 6/2011 Choi et al.
D640,819 S 6/2011 Pan
7,956,546 B2 6/2011 Hasnain
7,959,332 B2 6/2011 Tickner et al.
7,967,480 B2 6/2011 Pickard et al.
D642,317 S 7/2011 Rashidi
7,972,035 B2 7/2011 Boyer
7,972,043 B2 7/2011 Schutte
D642,536 S 8/2011 Robinson
D643,970 S 8/2011 Kim et al.
8,002,425 B2 8/2011 Russo et al.
D646,011 S 9/2011 Rashidi
8,013,243 B2 9/2011 Korcz et al.
8,038,113 B2 10/2011 Fryzek et al.
D648,476 S 11/2011 Choi et al.
D648,477 S 11/2011 Kim et al.
D650,115 S 12/2011 Kim et al.
8,070,328 B1 * 12/2011 Knoble ..... F21V 3/00 362/311.02
8,096,670 B2 1/2012 Trott
D654,205 S 2/2012 Rashidi
D656,262 S 3/2012 Yoshinobu et al.
D656,263 S 3/2012 Ogawa et al.
8,142,057 B2 3/2012 Roos et al.
8,152,334 B2 4/2012 Krogman
D658,788 S 5/2012 Dudik et al.
D658,802 S 5/2012 Chen
D659,862 S 5/2012 Tsai
D659,879 S 5/2012 Rashidi
D660,814 S 5/2012 Wilson
8,182,116 B2 5/2012 Zhang et al.
8,201,968 B2 6/2012 Maxik et al.
D663,058 S 7/2012 Pan
D663,466 S 7/2012 Rashidi
D664,274 S 7/2012 de Visser et al.
D664,705 S 7/2012 Kong et al.
8,215,805 B2 7/2012 Cogliano et al.
8,220,970 B1 7/2012 Khazi et al.
8,226,270 B2 7/2012 Yamamoto et al.
8,235,549 B2 8/2012 Gingrich, III et al.
8,240,630 B2 8/2012 Wronski
D667,155 S 9/2012 Rashidi
8,262,255 B1 9/2012 Rashidi
D668,372 S 10/2012 Renshaw et al.
D668,809 S 10/2012 Rashidi
D669,198 S 10/2012 Qui
D669,199 S 10/2012 Chuang
D669,620 S 10/2012 Rashidi
8,277,090 B2 10/2012 Fryzek et al.
D671,668 S 11/2012 Rowlette, Jr. et al.
8,308,322 B2 11/2012 Santiago et al.
D672,899 S 12/2012 Ven et al.
D673,869 S 1/2013 Yu
D676,263 S 2/2013 Birke
D676,814 S 2/2013 Paul
8,376,593 B2 2/2013 Bazydola et al.
D677,417 S 3/2013 Rashidi
D677,634 S 3/2013 Korcz et al.
D679,044 S 3/2013 Jeswani et al.
D679,047 S 3/2013 Tickner et al.
8,403,533 B1 3/2013 Paulsel
8,403,541 B1 3/2013 Rashidi
8,405,947 B1 3/2013 Green et al.
D681,259 S 4/2013 Kong
8,408,759 B1 4/2013 Rashidi
D682,459 S 5/2013 Gordin et al.
D683,063 S 5/2013 Lopez et al.
D683,890 S 6/2013 Lopez et al.
D684,269 S 6/2013 Wang et al.
D684,287 S 6/2013 Rashidi
D684,719 S 6/2013 Rashidi
D685,118 S 6/2013 Rashidi
D685,120 S 6/2013 Rashidi
8,454,204 B1 6/2013 Chang et al.
D685,507 S 7/2013 Sun
D687,586 S 8/2013 Rashidi
D687,587 S 8/2013 Rashidi
D687,588 S 8/2013 Rashidi
D687,980 S 8/2013 Gravely et al.
D688,405 S 8/2013 Kim et al.
8,506,127 B2 8/2013 Russello et al.
8,506,134 B2 8/2013 Wilson et al.
D690,049 S 9/2013 Rashidi
D690,864 S 10/2013 Rashidi
D690,865 S 10/2013 Rashidi
D690,866 S 10/2013 Rashidi
D691,314 S 10/2013 Rashidi
D691,315 S 10/2013 Samson

(56) References Cited

U.S. PATENT DOCUMENTS

D691,763 S 10/2013 Hand et al.
8,550,669 B2 10/2013 Macwan et al.
D693,043 S 11/2013 Schmalfuss et al.
D693,517 S 11/2013 Davis
D694,456 S 11/2013 Rowlette, Jr. et al.
8,573,816 B2 11/2013 Negley et al.
D695,441 S 12/2013 Lui et al.
D695,941 S 12/2013 Rashidi
D696,446 S 12/2013 Huh
D696,447 S 12/2013 Huh
D696,448 S 12/2013 Huh
8,602,601 B2 12/2013 Khazi et al.
D698,067 S 1/2014 Rashidi
D698,068 S 1/2014 Rashidi
8,622,361 B2 1/2014 Wronski
8,632,040 B2 1/2014 Mass et al.
D698,985 S 2/2014 Lopez et al.
D699,384 S 2/2014 Rashidi
D699,687 S 2/2014 Baldwin et al.
D700,387 S 2/2014 Snell
8,641,243 B1 2/2014 Rashidi
8,659,034 B2 2/2014 Baretz et al.
D700,991 S 3/2014 Johnson et al.
D701,175 S 3/2014 Baldwin et al.
D701,466 S 3/2014 Clifford et al.
8,672,518 B2 3/2014 Boomgaarden et al.
D702,867 S 4/2014 Kim et al.
D703,843 S 4/2014 Cheng
8,684,569 B2 4/2014 Pickard et al.
D705,472 S 5/2014 Huh
D705,481 S 5/2014 Zhang et al.
8,727,582 B2 5/2014 Brown et al.
D708,381 S 7/2014 Rashidi
8,777,449 B2 7/2014 Ven et al.
D710,529 S 8/2014 Lopez et al.
8,801,217 B2 8/2014 Oehle et al.
8,820,985 B1 9/2014 Tam et al.
8,833,013 B2 9/2014 Harman
8,845,144 B1 9/2014 Davies et al.
D714,989 S 10/2014 Rowlette, Jr. et al.
8,870,426 B2 10/2014 Biebl et al.
8,890,414 B2 11/2014 Rowlette, Jr. et al.
D721,845 S 1/2015 Lui et al.
8,926,133 B2 1/2015 Booth
8,939,418 B2 1/2015 Green et al.
D722,296 S 2/2015 Taylor
D722,977 S 2/2015 Hagarty
D722,978 S 2/2015 Hagarty
8,950,898 B2 2/2015 Catalano
D723,781 S 3/2015 Miner
D723,783 S 3/2015 Miner
D725,359 S 3/2015 Miner
8,967,575 B1 3/2015 Gretz
D726,363 S 4/2015 Danesh
D726,949 S 4/2015 Redfern
9,004,435 B2 4/2015 Wronski
9,039,254 B2 5/2015 Danesh
D731,689 S 6/2015 Bernard et al.
9,062,866 B1 6/2015 Christ et al.
9,065,264 B2 6/2015 Cooper et al.
9,068,719 B2 6/2015 Van De Ven et al.
9,068,722 B2 6/2015 Wronski et al.
D734,525 S 7/2015 Gordin et al.
D735,012 S 7/2015 Cowie
D735,142 S 7/2015 Hagarty
9,078,299 B2 7/2015 Ashdown
D739,355 S 9/2015 D'Aubeterre
D739,590 S 9/2015 Redfern
9,140,441 B2 9/2015 Goelz et al.
D741,538 S 10/2015 Ghasabi
D742,325 S 10/2015 Leung
9,151,457 B2 10/2015 Pickard et al.
9,151,477 B2 10/2015 Pickard et al.
D743,079 S 11/2015 Adair
D744,723 S 12/2015 Yoo
9,217,560 B2 12/2015 Harbers et al.
9,222,661 B2 12/2015 Kim et al.
9,239,131 B1 1/2016 Wronski et al.
D750,317 S 2/2016 Lui et al.
9,285,103 B2 3/2016 Van De Ven et al.
9,291,319 B2 3/2016 Kathawate et al.
9,301,362 B2 3/2016 Dohn et al.
D754,078 S 4/2016 Baldwin et al.
D754,079 S 4/2016 Baldwin et al.
D754,605 S 4/2016 McMillan
9,303,812 B2 4/2016 Green et al.
9,310,038 B2 4/2016 Athalye
9,322,543 B2 4/2016 Hussell et al.
9,347,655 B2 5/2016 Boomgaarden et al.
9,366,418 B2 6/2016 Gifford
9,371,966 B2 6/2016 Rowlette, Jr. et al.
D762,181 S 7/2016 Lin
9,395,051 B2 7/2016 Hussell et al.
D762,906 S 8/2016 Jeswani et al.
D764,079 S 8/2016 Wu
9,404,639 B2 8/2016 Bailey et al.
9,417,506 B1 8/2016 Tirosh
D766,185 S 9/2016 Hagarty
D767,199 S 9/2016 Wronski et al.
9,447,917 B1 9/2016 Wronski et al.
9,447,953 B2 9/2016 Lawlor
D768,325 S 10/2016 Xu
D768,326 S 10/2016 Guzzini
D769,501 S 10/2016 Jeswani et al.
D770,065 S 10/2016 Tittle
D770,076 S 10/2016 Li et al.
9,476,552 B2 10/2016 Myers et al.
D774,676 S 12/2016 Ng
D776,324 S 1/2017 Gierl et al.
D777,967 S 1/2017 Redfern
9,534,751 B2 1/2017 Maglica et al.
D778,241 S 2/2017 Holbrook et al.
D778,484 S 2/2017 Guzzini
D779,100 S 2/2017 Redfern
9,581,302 B2 2/2017 Danesh
9,599,315 B1 3/2017 Harpenau et al.
9,605,842 B1 3/2017 Davis
9,605,910 B2 3/2017 Swedberg et al.
D785,228 S 4/2017 Guzzini
D786,472 S 5/2017 Redfern
D786,473 S 5/2017 Dean
D786,474 S 5/2017 Fujisawa
D788,330 S 5/2017 Johnson et al.
D790,102 S 6/2017 Guzzini
9,673,597 B2 6/2017 Lee
9,689,541 B2 6/2017 Wronski
D791,709 S 7/2017 Holton
D791,711 S 7/2017 Holton
D791,712 S 7/2017 Holton
9,696,021 B2 7/2017 Wronski
9,702,516 B1 7/2017 Vasquez et al.
D795,820 S 8/2017 Wengreen
9,732,904 B1 8/2017 Wronski
9,732,947 B1 8/2017 Christ et al.
9,739,464 B2 8/2017 Wronski
D799,105 S 10/2017 Eder et al.
D800,957 S 10/2017 Eder et al.
9,791,111 B1 10/2017 Huang et al.
9,797,562 B2 10/2017 Dabiet et al.
9,803,839 B2 10/2017 Visser et al.
D805,660 S 12/2017 Creasman et al.
D809,176 S 1/2018 Partington
9,860,961 B2 1/2018 Chemel et al.
9,863,619 B2 1/2018 Mak
D809,465 S 2/2018 Keirstead
9,903,569 B2 2/2018 O'Brien et al.
9,964,266 B2 5/2018 Danesh
D820,494 S 6/2018 Cohen
D821,615 S 6/2018 Trice
D821,627 S 6/2018 Ko
9,995,441 B2 6/2018 Power et al.
D822,505 S 7/2018 Gibson et al.
D824,494 S 7/2018 Martins et al.
D825,829 S 8/2018 Guo

(56) References Cited

U.S. PATENT DOCUMENTS 10,041,638 B2 8/2018 Vasquez et al.
10,054,274 B2 8/2018 Athalye et al.
D827,903 S 9/2018 Wu
D832,218 S 10/2018 Wronski et al.
D833,977 S 11/2018 Danesh et al.
10,125,959 B2 11/2018 Cohen
10,139,059 B2 11/2018 Danesh
D836,976 S 1/2019 Reese et al.
D847,414 S 4/2019 Danesh et al.
D847,415 S 4/2019 Danesh et al.
10,247,390 B1 4/2019 Kopitzke, IV
D848,375 S 5/2019 Danesh et al.
10,281,131 B2 5/2019 Cohen
10,295,163 B1 5/2019 Cohen
D850,695 S 6/2019 Dabiet et al.
D851,046 S 6/2019 Peng et al.
10,408,395 B2 9/2019 Danesh
10,408,396 B2 9/2019 Wronski et al.
10,408,436 B2 9/2019 Wronski et al.
D863,661 S 10/2019 Tian et al.
D864,467 S 10/2019 Mizobe
D864,877 S 10/2019 Danesh
D867,653 S 11/2019 Gorman
10,488,000 B2 11/2019 Danesh et al.
10,551,044 B2 2/2020 Peng et al.
10,563,850 B2 2/2020 Danesh
10,591,120 B2 3/2020 Bailey et al.
D880,733 S 4/2020 Lo et al.
D883,562 S 5/2020 Hu
D885,648 S 5/2020 Zeng
D885,649 S 5/2020 McLaughlin, III et al.
10,663,127 B2 5/2020 Danesh et al.
10,663,153 B2 5/2020 Nikooyan et al.
D888,313 S 6/2020 Xie et al.
10,683,994 B2 6/2020 Wronski et al.
10,684,003 B2 6/2020 Wronski et al.
D890,410 S 7/2020 Stanford et al.
10,753,558 B2 8/2020 Danesh
10,816,148 B2 10/2020 Danesh
D901,398 S 11/2020 Danesh et al.
D901,745 S 11/2020 Yang
D902,871 S 11/2020 Danesh et al.
D903,605 S 12/2020 Danesh et al.
2002/0172047 A1 11/2002 Ashley
2003/0006353 A1 1/2003 Dinh et al.
2003/0016532 A1 1/2003 Reed
2003/0021104 A1 1/2003 Tsao
2003/0161153 A1 8/2003 Patti
2004/0001337 A1 1/2004 Defouw et al.
2004/0120141 A1 6/2004 Beadle
2004/0156199 A1 8/2004 Rivas et al.
2005/0078474 A1 4/2005 Whitfield
2005/0225966 A1 10/2005 Hartmann et al.
2005/0227536 A1 10/2005 Gamache et al.
2005/0231962 A1 10/2005 Koba et al.
2005/0237746 A1 10/2005 Yiu
2006/0005988 A1 1/2006 Jorgensen
2006/0158873 A1 7/2006 Newbold et al.
2006/0198126 A1 9/2006 Jones
2006/0215408 A1 9/2006 Lee
2006/0221620 A1 10/2006 Thomas
2006/0237601 A1 10/2006 Rinderer
2006/0243877 A1 11/2006 Rippel
2006/0250788 A1 11/2006 Hodge et al.
2006/0262536 A1 11/2006 Nevers
2006/0262545 A1 11/2006 Piepgras et al.
2007/0012847 A1 1/2007 Tai
2007/0035951 A1 2/2007 Tseng
2007/0121328 A1 5/2007 Mondloch et al.
2007/0131827 A1 6/2007 Nevers et al.
2007/0185675 A1 8/2007 Papamichael et al.
2007/0200039 A1 8/2007 Petak
2007/0206374 A1 9/2007 Petrakis et al.
2008/0002414 A1 1/2008 Miletich et al.
2008/0112168 A1 5/2008 Pickard et al.
2008/0112170 A1 5/2008 Trott
2008/0112171 A1 5/2008 Patti et al.
2008/0130308 A1 6/2008 Behr et al.
2008/0137347 A1 6/2008 Trott et al.
2008/0165545 A1 7/2008 O'Brien
2008/0170404 A1 7/2008 Steer et al.
2008/0224008 A1 9/2008 Dal Ponte et al.
2008/0232116 A1 9/2008 Kim
2008/0247181 A1 10/2008 Dixon
2008/0285271 A1 11/2008 Roberge et al.
2009/0003009 A1 1/2009 Tessnow et al.
2009/0034261 A1 2/2009 Grove
2009/0080189 A1 3/2009 Wegner
2009/0086484 A1 4/2009 Johnson
2009/0097262 A1 4/2009 Zhang et al.
2009/0135613 A1 5/2009 Peng
2009/0141500 A1 6/2009 Peng
2009/0141506 A1 6/2009 Lan et al.
2009/0141508 A1 6/2009 Peng
2009/0147517 A1 6/2009 Li
2009/0161356 A1 6/2009 Negley et al.
2009/0237924 A1 9/2009 Ladewig
2009/0280695 A1 11/2009 Sekela et al.
2009/0283292 A1 11/2009 Lehr
2009/0290343 A1* 11/2009 Brown ..... F21K 9/00 362/235
2010/0014282 A1 1/2010 Danesh
2010/0033095 A1 2/2010 Sadwick
2010/0061108 A1 3/2010 Zhang et al.
2010/0110690 A1 5/2010 Hsu et al.
2010/0110698 A1 5/2010 Harwood et al.
2010/0110699 A1 5/2010 Chou
2010/0148673 A1 6/2010 Stewart et al.
2010/0149822 A1 6/2010 Cogliano et al.
2010/0165643 A1 7/2010 Russo et al.
2010/0244709 A1 9/2010 Steiner et al.
2010/0246172 A1 9/2010 Liu
2010/0259919 A1 10/2010 Khazi et al.
2010/0270903 A1 10/2010 Jao et al.
2010/0277905 A1 11/2010 Janik et al.
2010/0284185 A1 11/2010 Ngai
2010/0302778 A1 12/2010 Dabiet et al.
2011/0043040 A1 2/2011 Porter et al.
2011/0063831 A1 3/2011 Cook
2011/0068687 A1 3/2011 Takahasi et al.
2011/0069499 A1 3/2011 Trott et al.
2011/0080750 A1 4/2011 Jones et al.
2011/0116276 A1 5/2011 Okamura et al.
2011/0121756 A1 5/2011 Thomas et al.
2011/0134634 A1 6/2011 Gingrich, III et al.
2011/0134651 A1 6/2011 Berman
2011/0140633 A1 6/2011 Archenhold
2011/0170294 A1 7/2011 Mier-Langner et al.
2011/0194299 A1 8/2011 Crooks et al.
2011/0216534 A1 9/2011 Tickner et al.
2011/0226919 A1 9/2011 Fryzek et al.
2011/0255292 A1 10/2011 Shen
2011/0267828 A1 11/2011 Bazydola et al.
2011/0285314 A1 11/2011 Carney et al.
2012/0020104 A1 1/2012 Biebl et al.
2012/0074852 A1 3/2012 Delnoij
2012/0106176 A1 5/2012 Lopez et al.
2012/0113642 A1 5/2012 Catalano
2012/0140442 A1 6/2012 Woo et al.
2012/0140465 A1 6/2012 Rowlette, Jr. et al.
2012/0162994 A1 6/2012 Wasniewski et al.
2012/0182744 A1 7/2012 Santiago et al.
2012/0188762 A1 7/2012 Joung et al.
2012/0243237 A1 9/2012 Toda et al.
2012/0266449 A1 10/2012 Krupa
2012/0268688 A1 10/2012 Sato et al.
2012/0287625 A1 11/2012 Macwan et al.
2012/0305868 A1 12/2012 Callahan et al.
2012/0314429 A1 12/2012 Plunk
2013/0009552 A1 1/2013 Page
2013/0010476 A1 1/2013 Pickard et al.
2013/0016864 A1 1/2013 Ivey et al.
2013/0033872 A1 2/2013 Randolph et al.
2013/0051012 A1 2/2013 Oehle et al.

(56) References Cited

U.S. PATENT DOCUMENTS

| | | | |
|---|---|---|---|
| 2013/0077307 | A1 | 3/2013 | Yamamoto |
| 2013/0083529 | A1 | 4/2013 | Gifford |
| 2013/0141913 | A1 | 6/2013 | Sachsenweger |
| 2013/0155681 | A1 | 6/2013 | Nall et al. |
| 2013/0163254 | A1 | 6/2013 | Chang et al. |
| 2013/0170232 | A1 | 7/2013 | Park et al. |
| 2013/0170233 | A1 | 7/2013 | Nezu et al. |
| 2013/0227908 | A1 | 9/2013 | Gulbrandsen et al. |
| 2013/0258677 | A1 | 10/2013 | Fryzek et al. |
| 2013/0265750 | A1 | 10/2013 | Pickard et al. |
| 2013/0271989 | A1 | 10/2013 | Hussell et al. |
| 2013/0294084 | A1 | 11/2013 | Kathawate et al. |
| 2013/0301252 | A1 | 11/2013 | Hussell et al. |
| 2013/0322062 | A1 | 12/2013 | Danesh |
| 2013/0322084 | A1 | 12/2013 | Ebisawa |
| 2013/0335980 | A1 | 12/2013 | Nakasuji et al. |
| 2014/0029262 | A1 | 1/2014 | Maxik et al. |
| 2014/0036497 | A1 | 2/2014 | Hussell et al. |
| 2014/0049957 | A1 | 2/2014 | Goelz et al. |
| 2014/0063776 | A1 | 3/2014 | Clark et al. |
| 2014/0071679 | A1 | 3/2014 | Booth |
| 2014/0071687 | A1 | 3/2014 | Tickner et al. |
| 2014/0140490 | A1 | 5/2014 | Roberts et al. |
| 2014/0063818 | A1 | 6/2014 | Randolph et al. |
| 2014/0233246 | A1 | 8/2014 | Lafreniere et al. |
| 2014/0254177 | A1 | 9/2014 | Danesh |
| 2014/0268836 | A1 | 9/2014 | Thompson |
| 2014/0268869 | A1 | 9/2014 | Blessitt et al. |
| 2014/0299730 | A1 | 10/2014 | Green et al. |
| 2014/0313775 | A1 | 10/2014 | Myers et al. |
| 2014/0321122 | A1 | 10/2014 | Domagala et al. |
| 2014/0347848 | A1 | 11/2014 | Pisavadia et al. |
| 2015/0009676 | A1 | 1/2015 | Danesh |
| 2015/0029732 | A1 | 1/2015 | Hatch |
| 2015/0078008 | A1 | 3/2015 | He |
| 2015/0085500 | A1 | 3/2015 | Cooper et al. |
| 2015/0138779 | A1 | 5/2015 | Livesay et al. |
| 2015/0184837 | A1 | 7/2015 | Zhang et al. |
| 2015/0198324 | A1 | 7/2015 | O'Brien et al. |
| 2015/0219317 | A1 | 8/2015 | Gatof et al. |
| 2015/0233556 | A1* | 8/2015 | Danesh ..... F21S 8/02 362/365 |
| 2015/0241039 | A1 | 8/2015 | Fryzek |
| 2015/0263497 | A1 | 9/2015 | Korcz et al. |
| 2015/0276185 | A1 | 10/2015 | Bailey et al. |
| 2015/0308662 | A1 | 10/2015 | Vice et al. |
| 2015/0345761 | A1 | 12/2015 | Lawlor |
| 2015/0362159 | A1 | 12/2015 | Ludyjan |
| 2016/0084488 | A1 | 3/2016 | Wu et al. |
| 2016/0209007 | A1 | 7/2016 | Belmonte et al. |
| 2016/0238225 | A1 | 8/2016 | Doust |
| 2016/0308342 | A1 | 10/2016 | Witherbee et al. |
| 2016/0312987 | A1 | 10/2016 | Danesh |
| 2016/0348860 | A1 | 12/2016 | Bailey et al. |
| 2016/0348861 | A1 | 12/2016 | Bailey et al. |
| 2016/0366738 | A1 | 12/2016 | Boulanger et al. |
| 2017/0003007 | A1 | 1/2017 | Wronski |
| 2017/0045213 | A1 | 2/2017 | Williams et al. |
| 2017/0059135 | A1 | 3/2017 | Jones |
| 2017/0138576 | A1 | 5/2017 | Peng et al. |
| 2017/0138581 | A1 | 5/2017 | Doust |
| 2017/0167672 | A1 | 6/2017 | Stauner et al. |
| 2017/0167699 | A1 | 6/2017 | Schubert et al. |
| 2017/0198896 | A1 | 7/2017 | May |
| 2017/0284616 | A1 | 10/2017 | Coakley et al. |
| 2017/0307188 | A1 | 10/2017 | Oudina et al. |
| 2018/0112857 | A1 | 4/2018 | Wronski et al. |
| 2018/0142871 | A1 | 5/2018 | Morales |
| 2018/0216809 | A1 | 8/2018 | Cohen |
| 2018/0224095 | A1 | 8/2018 | Cohen |
| 2018/0283677 | A1 | 10/2018 | Cohen |
| 2019/0032874 | A1 | 1/2019 | Bonnetto et al. |
| 2019/0041050 | A1 | 2/2019 | Cairns et al. |
| 2019/0049080 | A1 | 2/2019 | Danesh |
| 2019/0093836 | A1 | 3/2019 | Danesh |
| 2020/0182420 | A1 | 6/2020 | Cohen et al. |
| 2020/0291652 | A1 | 9/2020 | Shen |
| 2021/0010647 | A1 | 1/2021 | Danesh et al. |

FOREIGN PATENT DOCUMENTS

| | | | |
|---|---|---|---|
| CA | 2691480 | C | 4/2012 |
| CA | 2734369 | A1 | 10/2013 |
| CA | 2561459 | A1 | 11/2013 |
| CA | 2815067 | | 11/2013 |
| CA | 2848289 | A1 | 10/2014 |
| CA | 2998173 | | 7/2018 |
| CN | 2182475 | Y | 11/1994 |
| CN | 201059503 | Y | 5/2008 |
| CN | 201259125 | Y | 6/2009 |
| CN | 101608781 | A | 12/2009 |
| CN | 201636626 | U | 11/2010 |
| CN | 102062373 | A | 5/2011 |
| CN | 202014067 | U | 10/2011 |
| CN | 202392473 | U | 8/2012 |
| CN | 202733693 | U | 2/2013 |
| CN | 103307518 | A | 9/2013 |
| CN | 103322476 | A | 9/2013 |
| CN | 203202661 | U | 9/2013 |
| CN | 203215483 | U | 9/2013 |
| CN | 20327663 | U | 11/2013 |
| CN | 101498411 | B | 11/2013 |
| CN | 203297980 | U | 11/2013 |
| CN | 203628464 | U | 6/2014 |
| CN | 203641919 | U | 6/2014 |
| CN | 204300818 | U | 4/2015 |
| CN | 104654142 | A | 5/2015 |
| CN | 204513161 | U | 7/2015 |
| CN | 204611541 | U | 9/2015 |
| CN | 204786225 | U | 11/2015 |
| CN | 204829578 | U | 12/2015 |
| CN | 103712135 | B | 4/2016 |
| CN | 205606362 | U | 9/2016 |
| CN | 2016130742 | U | 4/2017 |
| CN | 103154606 | B | 5/2017 |
| CN | 206222112 | U | 6/2017 |
| CN | 107013845 | A | 8/2017 |
| CN | 107084343 | A | 8/2017 |
| DE | 9109828 | U1 | 2/1992 |
| DE | 199 47 208 | | 5/2001 |
| EP | 1 589 289 | | 10/2005 |
| EP | 1 672 155 | A1 | 6/2006 |
| EP | 1688663 | | 8/2006 |
| EP | 2 095 938 | A1 | 2/2008 |
| EP | 2 306 072 | A1 | 4/2011 |
| EP | 2 453 169 | A2 | 5/2012 |
| EP | 2 193 309 | B1 | 7/2012 |
| EP | 2 735 787 | A1 | 5/2014 |
| EP | 3 104 024 | A1 | 12/2016 |
| GB | 2325728 | | 12/1998 |
| GB | 2427020 | A | 12/2006 |
| GB | 2466875 | | 7/2010 |
| GB | 2471929 | | 1/2014 |
| GB | 2509772 | A | 7/2014 |
| JP | H02113002 | U | 9/1990 |
| JP | 2007091052 | A | 4/2007 |
| JP | 2007265961 | A | 10/2007 |
| JP | 2011060450 | A2 | 3/2011 |
| JP | 2012064551 | A2 | 3/2012 |
| JP | 2015002027 | A2 | 1/2015 |
| JP | 2015002028 | A2 | 1/2015 |
| JP | 2016219335 | A | 12/2016 |
| JP | 2017107699 | A2 | 6/2017 |
| KR | 1020110008796 | A | 1/2011 |
| KR | 1020120061625 | A | 6/2012 |
| MX | 2011002947 | A | 9/2011 |
| TW | 474382 | U | 1/2002 |
| WO | WO 2013/128896 | A1 | 9/2013 |

(56) References Cited

FOREIGN PATENT DOCUMENTS

| | | |
|---|---|---|
| WO | WO 2015/000212 A1 | 1/2015 |
| WO | WO 2016/152116 A2 | 9/2016 |

OTHER PUBLICATIONS

U.S. Appl. No. 15/853,400, filed Dec. 22, 2017, Kashani.
U.S. Appl. No. 15/901,738, filed Feb. 21, 2018, Danesh.
U.S. Appl. No. 15/947,065, filed Apr. 6, 2018, Danesh.
U.S. Appl. No. 29/638,259, filed Feb. 26, 2018, Danesh.
U.S. Appl. No. 29/541,565, filed Oct. 5, 2015, Peng.
Acrich COB Zhaga Module, Product Description, Seoul Semiconductor, Nov. 2016, 39 pages.
<https://www.zhagastandard.org/books/book18/>, Mar. 2017, 5 pages.
Non-Final Office Action dated May 16, 2018 for U.S. Appl. No. 15/132,875, 18 pages.
Notice of Allowance dateed May 10, 2018 from U.S. Appl. No. 14/726,064, 7 pages.
"Advanced LED Solutions," Imtra Marine Lighting. 2011. 39 pages.
"Cree LMH2 LED Module with TrueWhite Technology," Cree Product Family Data Sheet. 2011. 3 pages.
"Cree LMH2 LED Modules Design Guide," Cree Product Design Guide. 2011. 20 pages.
"Cree LMH2 LED Modules," Mouser Electronics. 2 pages.
"LED Undercabinet Pocket Guide," ELCO Lighting.12 pages.
"Portland Bi-Color, Warm White/Red," item:ILIM30941.Imtra Marine Products. 2012. 3 pages.
"Undercabinet Pucks, Xyris Mini LED Puck Light," ELCO Lighting. Sep. 2018. 1 page.
"VERSI LED Mini Flush," Lithonia Lghting. 6 pages.
Civil Action No. 2:18-cv-07090. Complaint for Infringement and Unfair Competition. *DMF, Inc.* v. *AMP Plus, Inc. d/b/a ELCO Lighting*. 52 pages. Dated Aug. 15, 2018.
Cree LED Lamp Family Sales Sheet—Better light is beautiful light , Apr. 24, 2017, 2 pages.
International Search Report and Written Opinion in International Patent Application No. PCT/US18/39048 dated Dec. 14, 2018 24 pages.
International Search Report and Written Opinion in PCT/US2018/048357 dated Nov. 14, 2018, 13 pages.
Non-Final Office Action dated Dec. 5, 2018 from U.S. Appl. No. 14/942,937, 13 pages.
Non-Final Office Action dated Feb. 7, 2019 from U.S. Appl. No. 16/200,393, 32 pages.
Non-Final Office Action dated Jul. 24, 2018 from U.S. Appl. No. 29/638,259, 5 pages.
Non-Final Office Action dated Jun. 25, 2018 for U.S. Appl. No. 29/541,565, 10 pages.
Notice of Allowance dated Feb. 8, 2019 from U.S. Appl. No. 29/541,565, 5 pages
Notice of Allowance dated Jan. 2, 2019 from U.S. Appl. No. 29/541,565, 6 pages.
Notice of Allowance dated Jan. 28, 2019 from U.S. Appl. No. 29/664,471, 8 pages.
Notice of Allowance dated May 22, 2018 from U.S. Appl. No. 14/183,424, 9 pages.
Notice of Allowance dated Nov. 27, 2018 from U.S. Appl. No. 15/167,682, 11 pages.
Notice of Allowance dated Oct. 4, 2018 from U.S. Appl. No. 15/947,065 , 9 pages.
Notice of Allowance dated Oct. 9, 2018 from U.S. Appl. No. 29/653,142, 7 pages.
Notice of Allowance dated Sep. 19, 2018 from U.S. Appl. No. 15/167,682 , 7 pages.
Notice of Allowance dated Sep. 21, 2018 from U.S. Appl. No. 29/645,941, 5 pages.
OneFrame Recessed LED Downlight. Dmflighting.com. Published Jun. 6, 2018. Retrieved at https://www.dmflighting.com/product/oneframe on Jun. 6, 2018. 11 pages.
RACO 4 in. Octagon Welded Concrete Ring, 3-½ in. Deep with ½ and ¾ in. Knockouts and ilcludes 890 cover (20-Pack). Model # 280. Accessed at https://www.homedepot.com/p/RACO-4-in-Octagon-Welded-Concrete-Ring-3-1-2-in-Deep-with-1-2-and-3-4-in-Knockouts-and-ilcludes-890-cover-20-Pack-280/203638679 on Jan. 18, 2019. 3 pages.
RACO 4 in. Octagon Welded Concrete Ring, 6 in. Deep with ½ and ¾ in. Knockouts (10-Pack). Model # 276. Accessed at https://www.homedepot.com/p/RACO-4-in-Octagon-Welded-Concrete-Ring-6-in-Deep-with-1-2-and-3-4-in-Knockouts-10-Pack-276/203638675 on Jan. 16, 2019. 4 pages.
Final Office Action dated Mar. 15, 2019 from U.S. Appl. No. 15/132,875,15 pages.
International Search Report and Written Opinion in International Patent Application No. PCT/US18/62868 dated Mar. 14, 2019, 13 pages.
CS&E PCT Collaborative Search and Examination Pilot Upload Peer Contribution in International Patent Application No. PCT/US18/62868 dated Mar. 14, 2019, 61 pages.
Notice of Allowance dated Apr. 1, 2019 from U.S. Appl. No. 15/167,682, 7 pages.
Non-Final Office Action dated Apr. 4, 2019 from U.S. Appl. No. 29/678,482, 8 pages.
Notice of Allowance dated Apr. 8, 2019 from U.S. Appl. No. 29/653,142, 8 pages.
Notice of Allowance dated Apr. 17, 2019 from U.S. Appl. No. 29/678,478, 7 pages.
International Search Report and Written Opinion in International Patent Application No. PCT/US18/67614 dated Apr. 25, 2019, 20 pages.
CS&E PCT Collaborative Search and Examination Pilot Upload Peer Contribution in International Patent Application No. PCT/US18/67614 dated Apr. 24, 2019, 53 pages.
Specification & Features 4" Octagonal Concrete Box Covers. Orbit Industries, Inc. Accessed at https://www.orbitelectric.com on May 6, 2019. 1 page.
4" Octagon Concrete Boxes and Back Plates. Appleton. Accessed at www.appletonelec.com on May 6, 2019. 1 page.
RACO Commercial, Industrial and Residential Electrical Products. Hubbell. Accessed at www.Hubbell-RTB.com on May 6, 2019. 356 pages.
Imtra Marine Lighting 2008 Catalog. 40 pages.
Imtra Marine Lighting 2009 Catalog. 32 pages.
Imtra Marine Lighting Spring 2007 Catalog. 36 pages.
Non-Final Office Action dated Jun. 11, 2019 from U.S. Appl. No. 15/901,738, 6 pages.
Notice of Allowance dated Jun. 12, 2019 from U.S. Appl. No. 16/016,040, 8 pages.
Cooper Lighting HALO ML56 LED System Product Sheet. Mar. 2, 2015. Accessed at http://www.cooperindustries.com/content/dam/public/lighting/products/documents/halo/spec_sheets/halo-ml56600-80cri-141689-sss.pdf. 8 pages.
KWIKBRACE® New Construction Braces for Lighting Fixtures or Ceiling Fans 1-½ in. Depth. Hubbel. Accessed at https://hubbellcdn.com/specsheet/926.pdf on Jun. 27, 2019. 1 page.
IC1JB Housing 4" IC-Rated New Construction Junction Box Housing. AcuityBrands. Accessed at https://www.acuitybrands.com/en/products/detail/845886/juno/ic1jb-housing/4-ic-rated-new-construction-junction-box-housing on Jun. 27, 2019.
Ex-Parte Quayle Action mailed Jun. 27, 2019 from U.S. Appl. No. 29/683,730, 5 pages.
Notice of Allowance dated Jul. 31, 2019 from U.S. Appl. No. 15/167,682 , 7 pages.
Supplemental Notice of Allowance dated Aug. 5, 2019 from U.S. Appl. No. 15/947,065, 2 pages.
International Search Report and Written Opinion in International Patent Application No. PCT/US19/32281 dated Aug. 2, 2019, 18 pages.
Notice of Allowance dated Sep. 11, 2019 from U.S. Appl. No. 29/653,142, 6 pages.
Notice of Allowance dated Sep. 19, 2019 from U.S. Appl. No. 16/016,040, 7 pages.

(56) References Cited

OTHER PUBLICATIONS

Corrected Notice of Allowance dated Sep. 27, 2019 from U.S. Appl. No. 15/167,682 , 2 pages.
Final Office Action dated Sep. 27, 2019 from U.S. Appl. No. 16/200,393, 34 pages.
Notice of Allowance dated Feb. 15, 2019 from U.S. Appl. No. 15/947,065 , 9 pages.
Notice of Allowance dated Oct. 1, 2019 from U.S. Appl. No. 14/942,937, 7 pages.
Final Office Action dated Oct. 3, 2019 from U.S. Appl. No. 29/678,482, 6 pages.
Delhi Rehab & Nursing Facility ELM16-70884. Vertex Innovative Solutions Feb. 25, 2016. 89 pages.
SlimSurface surface mount downlighting. Philips Lightolier 2018. 8 pages.
Be seen in the best light. Lightolier by signify. Comprehensive 2019 Lighting Catalog. 114 pages.
Corrected Notice of Allowance dated Oct. 10, 2019 from U.S. Appl. No. 16/016,040, 2 pages.
Cree® LMR2 LED Module. Product Family Data Sheet Cree 2011. 3 pages.
Notice of Allowance dated Oct. 16, 2019 from U.S. Appl. No. 15/132,875, 12 pages.
International Search Report and Written Opinion in International Patent Application No. PCT/US2019/036477 dated Oct. 17, 2019, 15 pages.
ML56 LED Lighting System 600 / 900 / 1200 Series Halo. Cooper Lighting Brochure 2015. Accessed at https://images.homedepot-static.com/catalog/pdfImages/06/06d28f93-4bf6-45be-a35a-a0239606f227.pdf. 41 pages.
Switch and Outlet Boxes and Covers Brochure. Appelton 2010. 77 pages.
Non-Final Office Action dated Dec. 30, 2019 from U.S. Appl. No. 16/653,497, 8 pages.
Notice of Allowance dated Feb. 5, 2020 from U.S. Appl. No. 15/901,738 , 8 pages.
Notice of Allowance dated Feb. 5, 2020 from U.S. Appl. No. 29/678,482 , 13 pages.
Maxim Lighting Wafer Trifold Brochure LMXBRO1711 2017. Accessed at https://www.maximlighting.com/Upload/download/brochure/pdf/LMXBRO1711.pdf on Feb. 13, 2020. 2 pages.
Maxim Convert Fixture. LMXCAT1805 Maxim Main Catalog 2018 p. 639.
Maxim Wafer. LMXCAT1805 Maxim Main Catalog 2018 pp. 636-638.
Maxim Lighting Trim Trifold LMXBRO1905 2019. Accessed at https://www.maximlighting.com/Upload/download/brochure/pdf/LMXBRO1905.pdf on Feb. 13, 2020. 2 pages.
International Search Report and Written Opinion in International Patent Application No. PCT/US2019/054220 dated Feb. 24, 2020, 23 pages.
Final Office Action dated Mar. 17, 2020 for U.S. Appl. No. 29/653,142, 13 pages.
LED Book Pr ice Guide 2012. DMF Light. Issued Jun. 26, 2013. 3 pages.
DLER411 4" Recessed LED Retrofit Module. DMF Light. Issued Jun. 15, 2011. 1 page.
DLEI411 4" Recessed LED New Construction, IC. DMF Light. Issued Nov. 30, 2011. 1 page.
DLEIR411 4" Recessed LED Remodel, IC. DMF Light. Issued Jun. 15, 2011. 1 page.
3 & 4" DLE Series LED Sample Case Now Available. DMF Light. Issued Jan. 6, 2012. 1 page.
DLEI3 3" Recessed LED New Construction, IC. DMF Light. Issued Nov. 30, 2011. 2 pages.
Ridgway-Barnes, SlimSurface LED Downlight: One of the thinnest LED surface mount downlights in the market. Philips Lighting Blog. Oct. 28, 2014. Accessed at http://applications.nam.lighting.philips.com/blog/index.php/2014/10/28/slimsurface-led-downlight-one-of-the-thinnest-led-surface-mount-downlights-in-the-market/. 3 pages.
SlimSurface LED S5R, S7R & S10R Round 5", 7" and 10" Apertures. Lightolier by Signify. Nov. 2018. 9 pages.
Non-Final Office Action dated Apr. 2, 2020 for U.S. Appl. No. 16/522,275, 21 pages.
Notice of Allowance dated May 18, 2020 from U.S. Appl. No. 15/901,738 , 7 pages.
Non-Final Office Action dated May 26, 2020 for U.S. Appl. No. 16/719,361, 10 pages.
Maxim Lighting International, "Wafer LED 7" RD 3000K Wall/Flush Mount", undated.
Maxim Lighting International, "Convert LED Flush Mount", undated.
Maxim Lighting International, "Views of the Wafer Flush Mount", undated.
Maxim Lighting International, "Product/Drawing Specification Sheet", undated.
International Search Report and Written Opinion in PCT/US2020/017331 dated Jun. 22, 2020, 16 pages.
Taiwan Office Action and translation thereof dated Jun. 12, 2020 from Taiwan Application No. 108116564, 8 pages.
Access Lighting Installation Instructions. No. 20870LEDD/20871LEDD/20872LEDD. Dec. 16, 2019. 2 pages.
Model No. 20870LEDD-WH/ACR Infinite Specification Sheet. Access Lighting. Apr. 9, 2020. 1 page.
Notice of Allowance dated Apr. 9, 2020 from U.S. Appl. No. 16/653,497, 7 pages.
Notice of Allowance dated Jul. 10, 2020 from U.S. Appl. No. 29/694,475, 6 pages.
Corrected Notice of Allowability dated Oct. 25, 2018 from U.S. Appl. No. 14/183,424, 3 pages.
Dmf DRD2 Recessed LED Downlight General Retrofit Junction Box Dated: Dec. 18, 2015 Downloaded Jul. 28, 2018, from https://www.a lconlighting.com/specsheets/DMF/DRD2-Junction-Box-Retrofit-Spec-Sheet .pdf, 6 pages.
Dmf DRD2 Recessed LED Downlight General New Construction 4", 5", 6" Aperture Dated: Aug. 31, 2016 Downloaded Jul. 28, 2018, from https://www. cansandfans.com/sites/default/files/DRD2-General-New-Construction-Spec-Sheet_7_0 .pdf , 9 pages.
Mar 5, 2016—The DMF Lighting DRD2 Recessed LED Downlight General Retrofit Junction Box—Wet Location Rated is the ideal solution for Commercial LED recessed lighting retrofit applications. web cache https://ww w.alconlighting.com/dmf-drd2m.html (downloaded Jul. 28, 2018), 6 pages.
Ex Parte Quayle Office Action dated Oct. 16, 2018 for U.S. Appl. No. 29/663,037, 7 pages.
Notice of Allowance dated Nov. 19, 2018 from U.S. Appl. No. 29/663,037, 5 pages.
Notice of Allowance dated Nov. 15, 2018 from U.S. Appl. No. 29/663,040, 5 pages.
LED modules advance in performance, standardization questions persist (MAGAZINE). LEDs Magazine. Oct. 29, 2013. Accessed at https://www.ledsmagazine.com/leds-ssl-design/modular-light-engines/article/16695073/led-modules-advance-in-performance-standardization-questions-persist-magazine. 9 pages.
Notice of Allowance dated Jul. 20, 2020 from U.S. Appl. No. 29/648,046, 5 pages.
Octagon Concrete Box Cover with (3) ½ in. & (2) ¾ in. Conduit Knockouts. Garvin. Accessed at https://www.garvinindustries.com/covers-and-device-rings/concrete-slab-box-covers-adaptor-rings/flat-covers-all-styles/cbp?gclid=Cj0KCQjw9b_4BRCMARIsADMUlypJc0K80UHdDTI9C5m4BDzR3U87PRYV1NdQIBFxEWQ2I_3otTCTqEkaAi_DEALw_wcB on Jul. 20, 2020. 1 page.
Notice of Allowance dated Jul. 28, 2020 from U.S. Appl. No. 16/719,361, 8 pages.
Notice of Allowance dated Jul. 29, 2020 from U.S. Appl. No. 16/522,275, 8 pages.
Non-Final Office Action dated Aug. 19, 2020 for U.S. Appl. No. 16/886,365, 16 pages.
Notice of Allowance dated Sep. 8, 2020 from U.S. Appl. No. 29/678,482, 5 pages.

(56) References Cited

OTHER PUBLICATIONS

Corrected Notice of Allowance dated Sep. 11, 2020 from U.S. Appl. No. 16/719,361, 2 pages.
Canadian Office Action in Application No. 2931588 dated Aug. 13, 2020, 5 pages.
Corrected Notice of Allowance dated Sep. 14, 2020 from U.S. Appl. No. 16/522,275, 2 pages.
Notice of Allowance dated Sep. 22, 2020 from U.S. Appl. No. 29/683,730, 6 pages.
Notice of Allowance dated Sep. 22, 2020 from U.S. Appl. No. 29/653,142, 6 pages.
Notice of Allowance dated Oct. 27, 2020 from U.S. Appl. No. 29/648,046, 5 pages.
Notice of Allowance dated Oct. 27, 2020 from U.S. Appl. No. 29/694,475, 5 pages.
Notice of Allowance dated Nov. 10, 2020 from U.S. Appl. No. 29/688,143, 6 pages.
Notice of Allowance dated Nov. 10, 2020 from U.S. Appl. No. 29/688,172, 6 pages.
Non-Final Office Action dated Nov. 30, 2020 from U.S. Appl. No. 17/000,702, 7 pages.
Notice of Allowance dated Dec. 2, 2020 from U.S. Appl. No. 29/746,262, 6 pages.
International Search Report and Written Opinion in PCT/US2020/050767 dated Dec. 9, 2020, 25 pages.
Non-Final Office Action dated Dec. 16, 2020 from U.S. Appl. No. 17/080,080, 28 pages.
Canadian Office Action in Application No. 2941051 dated Dec. 8, 2020, 5 pages.
Non-Final Office Action dated Jan. 11, 2021 from U.S. Appl. No. 16/725,606, 7 pages.
Non-Final Office Action dated Jan. 13, 2021 from U.S. Appl. No. 17/085,636, 14 pages.
Notice of Allowance dated Jan. 15, 2021 from U.S. Appl. No. 17/000,702, 7 pages.
Notice of Allowance dated Jan. 22, 2021 from U.S. Appl. No. 17/080,080, 14 pages.
Notice of Allowance dated Jan. 22, 2021 from U.S. Appl. No. 16/886,365, 7 pages.
Final Office Action dated Feb. 5, 2021 from U.S. Appl. No. 16/200,393, 7 pages.
"Electrical Boxes" accessed at http://electrical-inspector.blogspot.com/2013/06/electrical-boxes.html Jun. 22, 2013 retrieved from Wayback Machine Archinve.org on Jan. 25, 2021. 12 pages.
"Electrical Boxes Volumes and Fill Calculations" accessed at http://electrical-inspector.blogspot.com/2013/06/electrical-boxes-Volume-and-Fill-Calculations.html Jun. 22, 2013 retrieved from Wayback Machine Archinve.org on Jan. 25, 2021. 8 pages.
U.S. Appl. No. 61/881,162, filed Sep. 23, 2013. Prioirty application to US Publication No. 2015/0085500 to Cooper et al. 31 pages.
Non-Final Office Action dated Jan. 19, 2021 from U.S. Appl. No. 17/099,650, 15 pages.
Supplemental Notice of Allowance dated Mar. 10, 2021 from U.S. Appl. No. 16/886,365, 2 pages.
Thiele, Plastic Electrical Boxes Pros and Cons. Dated Jul. 1, 2019. Accessed at found at https://www.thespruce.com/plastic-electrical-boxes-pros-and-cons-1152405. 1 page.
"Electrical Box" reference dated Mar. 23, 2021. Accessed at https://www.zoro.com/cantex-electrical-box-3-12-in-rouond-20-cu-in-ez20cnr-/i/G1823376/. 1 page.
Petition for Inter Partes Review of U.S. Pat. No. 9,964,266 Pursuant to 37 C.F.R. § 42.100 et seq. *AMP Plus Inc. dbd Elco Lighting* v. *DMF, Inc*, IPR2019-01094 filed May 17, 2019. 108 pages.
IPR2019-01094 Exhibit 1001. U.S. Pat. No. 9,964,266 ("'the Patent"). 14 pages.
IPR2019-01094 Exhibit 1002. Declaration of Eric Bretschneider, Ph.D. ("Bretschneider"). 107 pages.
IPR2019-01094 Exhibit 1003. Curriculum Vitae of Dr. Bretschneider. 11 pages.
IPR2019-01094 Exhibit 1004. Excerpts from the File History of U.S. Pat. No. 9,964,266. 105 pages.
IPR2019-01094 Exhibit 1005. Imtra 2011 Marine Lighting Catalog—Advanced LED Solutions ("Imtra 2011"). 40 pages.
IPR2019-01094 Exhibit 1006. Imtra 2007 Marine Lighting Catalog ("Imtra 2007"). 36 pages
IPR2019-01094 Exhibit 1007. U.S. Pat. No. 9,366,418 ("Gifford"). 9 pages.
IPR2019-01094 Exhibit 1008. Declaration of Colby Chevalier ("Chevalier"). 89 pages.
IPR2019-01094 Exhibit 1009. U.S. Pat. No. 7,102,172 ("Lynch"). 41 pages.
IPR2019-01094 Exhibit 1010. Illuminating Engineering Society, ANSI RP-16-10, Nomenclature and Definitions for Illuminating Engineering (approved as an American National Standard Jul. 15, 2005, approved by the IES Board of Directors Oct. 15, 2005). 4 pages.
IPR2019-01094 Exhibit 1011. Underwriters Laboratories Inc. Standard for Safety, Standard UL-8750, entitled Light Emitting Diode (LED) Equipment for Use in Lighting (1st ed. 2009). 5 pages.
IPR2019-01094 Exhibit 1012. Celanese CoolPoly® D5502 Thermally Conductive Liquid Crystalline Polymer Specification ("CoolPoly"). 1 page.
IPR2019-01094 Exhibit 1013. Illuminating Engineering Society of North America, IES Lighting Handbook (John E. Kaufman and Howard Haynes eds., Application vol. 1981) ("Lighting Handbook"). 5 pages.
IPR2019-01094 Exhibit 1014. California Energy Commission, PIER Lighting Research Program: Project 2.3 Low-profile LED Luminaires Final Report (Prepared by Lighting Research Center, Jan. 2005) ("Pier LRP"). 70 pages.
IPR2019-01094 Exhibit 1015. Jim Sinopoli, Using DC Power to Save Energy and End the War on Currents, GreenBiz (Nov. 15, 2012), https://www.greenbiz.com/news/2012/11/15/using-dc-power-save-energy-end-war-currents ("Sinopoli"). 6 pages.
IPR2019-01094 Exhibit 1016. Robert W. Johnson, "Thought Leadership White Paper: AC Versus DC Power Distribution" (Nov. 2012) ("Johnson"). 10 pages.
IPR2019-01094 Exhibit 1017. Lumileds, LUXEON Rebel General Purpose Product Datasheet, Specification DS64 (2016) ("Luxeon Rebel"). 26 pages.
IPR2019-01094 Exhibit 1018. U.S. Pat. No. 8,454,204 ("Chang"). 11 pages.
IPR2019-01094 Exhibit 1019. U.S. Department of Energy, CALiPER Benchmark Report: Performance of Incandescent A-Type and Decorative Lamps and LED Replacements (prepared by Pacific National Laboratory, Nov. 2008) ("CALiPER 2008"). 25 pages.
IPR2019-01094 Exhibit 1020. U.S. Pat. No. 3,836,766 ("Auerbach"). 13 pages.
IPR2019-01094 Exhibit 1021. U.S. Department of Energy, CALiPER Application Summary Report 16: LED BR30 and R30 Lamps (prepared by Pacific Northwest National Laboratory, Jul. 2012) ("CALiPER 2012"). 26 pages.
IPR2019-01094 Exhibit 1022. Sandia National Laboratories, Sandia Report: "The Case for a National Research Program on Semiconductor Lighting" (Jul. 2000) ("Haitz"). 24 pages.
IPR2019-01094 Exhibit 1023. Sylvania, Post Top Street Light LED Retrofit Kit Specification, LED40POST (2009) ("Sylvania"). 4 pages.
IPR2019-01094 Exhibit 1024. Webster's New Collegiate Dictionary (1973) ("Webster's"). 2 pages.
IPR2019-01094 Exhibit 1025. 3M Wire Connectors and Tools Catalog 2013 ("3M Catalog"). 22 pages.
IPR2019-01094 Exhibit 1026. Wakefield Semiconductor Heat Sinks and Thermal Products 1974 Catalog ("Wakefield"). 3 pages.
IPR2019-01094 Exhibit 1027. U.S. Department of Energy, Solid-State Lighting Research and Development Portfolio: Multi-Year Program Plan FY'07-FY'12 (prepared by Navigant Consulting, Inc., Mar. 2006) ("DOE 2006"). 129 pages.
IPR2019-01094 Exhibit 1028. U.S. Department of Energy, Solid-State Lighting ResearA1023:C1043elopment: Multi-Year Program Plan (Apr. 2013) ("DOE 2013"). 89 pages.

(56) References Cited

OTHER PUBLICATIONS

Declaration of Colby Chevalier from Central District of California Civil Docket for Case #: 2:18-cv-07090-CAS-GJS filed Jun. 3, 2019, signed Jun. 3, 2019. 2 pages.
Docket Listing in Inter Partes Review of U.S. Pat. No. 9,964,266. Docket Navegator *AMP Plus, Inc. d/b/a ELCO Lighting et al* v. *DMF, Inc*. PTAB-IPR2019-01094. Downloaded Mar. 25, 2020. 4 pages.
Petition for Inter Partes Review of U.S. Pat. No. 9,964,266 Pursuant to 37 C.F.R. § 42.100 et seq. *AMP Plus Inc. dbd ELCO Lighting* v. *DMF, Inc*, PTAB-IPR2019-01500 filed Aug. 14, 2019. 99 pages.
Docket Listing in Inter Partes Review of U.S. Pat. No. 9,964,266 . *AMP Plus, Inc. d/b/a ELCO Lighting et al* v. *DMF, Inc*. PTAB-IPR2019-01500. Downloaded Mar. 25, 2020. 3 pages.
Docket Listing in Civil Action No. 2:18-cv-07090. *DMF, Inc*. v. *AMP Plus, Inc. d/b/a ELCO Lighting et al* CDCA-2-18-cv-07090. Downloaded on Mar. 25, 2020. 39 pages.
Civil Action No. 2:19-cv-4519.Complaint for Patent Infringement. *DMF, Inc*. v. *AMP Plus, Inc. d/b/a ELCO Lighting*. 52 pages dated May 22, 2019. 23 pages.
Docket Listing in Civil Action No. 2:19-cv-4519. *DMF Inc* v. *AMP Plus, Inc. d/b/a ELCO Lighting et al* CDCA-2-19-cv-04519. Downloaded on Mar. 25, 2020. 3 pages.
Decision Denying Institution of Inter Partes Review of U.S. Pat. No. 9,964,266 in IPR2019-01500 dated Mar. 17, 2020. 21 pages.
Defendants' Notice of Prior Art Pursuant to 35 U.S.C. § 282 in Civil Action No. 2:18-cv-07090-CAS-GJS dated Feb. 28, 2020. 7 pages.
Defendant AMP Plus, Inc.'s Opposition to DMF's Motion for Summary Judgement in Civil Action No. 2:18-cv-07090-CAS-GJS filed Feb. 10, 2020. 32 pages.
Declaration of Eric Bretschneider, Ph.D In Support of Amp Plus, Inc.'s Opposition to Dmf, Inc.'s Motion for Partial Summary Judgment in Civil Action No. 2:18-cv-07090-CAS-GJS filed Feb. 10, 2020. 210 pages.
Plaintiff DMF's Reply in Support of Motion for Partial Summary Judgment in Civil Action No. 2:18-cv-07090-CAS-GJS filed Feb. 18, 2020. 33 pages.
Declaration of James R. Benya in Support of Plaintiff DMF's Motion for Summary Judgment in Civil Action No. 2:18-cv-07090-CAS-GJS filed Feb. 3, 2020. 193 pages.
Underwriters Laboratories Inc. Standard for Safely. UL 1598. Luminaires Jan. 11, 2020. 12 pages.
Exceptional LED Lighting Technology Product Portfolio. LightingScience 2012. 11 pages.
"Cree LMH2 LED Modules," Mouser Electronics. Sep. 9, 2012. 4 pages.
Slim Line Disc. EYE LEDs Specification Sheet 2012. 2 pages.
HiBay LED Heat Sink. Wakefield-vette. Dec. 11, 2017. 1 pages.
Thermal Management of Cree®XLamp® LEDs. Cree Application Note. 2004. 19 pages.
Imtra Marine Lighting Fall 2007 Catalog. 32 pages.
Cree LMH2 LED Modules Product Family Data Sheet. Cree 2011-2014, 18 pages.
Cree LMH2 LED Modules Design Guide. Cree 2011-2015, 23 pages.
Brochure of Elco EL49A, EL49ICA, EL49RA modules. ELCO Lighting Nov. 25, 2009. 1 page.
Image of Elco E347/247 module identified by Elco in response to DMF's Request for Production in Civil Action No. 2:18-cv-07090-CAS-GJS on Aug. 28, 2019. 1 page.
Screenshots from the Deposition of Brandon Cohen in Civil Action No. 2:18-cv-07090-CAS-GJS. Conducted Sep. 2, 2020. 8 pages.
Defendant AMP Plus, Inc.'s Initial Disclosure and Designation of Expert Witnesses in Civil Action No. 2:19-CV-4519-CAS. 37 pages.
Defendant AMP Plus, Inc. D/B/A Elco Lighting's Supplemental Responses to Plaintiff DMF, Inc.'s First Set of Interrogatories (Nos. 1-16) in Civil Action No. 2:19-CV-4519-CAS, Redacted. 13 pages.
Final Written Decision in IPR2019-01094 dated Nov. 19, 2020, 58 pages.
U.S. Appl. No. 16/016,040, filed Jun. 22, 2018, Danesh.
U.S. Appl. No. 16/200,393, filed Nov. 26, 2018, Danesh.
U.S. Appl. No. 29/653,142, filed Jun. 11, 2018, Danesh et al.
U.S. Appl. No. 29/664,471, filed Sep. 25, 2018, Danesh et al.
U.S. Appl. No. 29/678,478, filed Jan. 29, 2019, Danesh et al.
U.S. Appl. No. 29/678,482, filed Jan. 29, 2019, Danesh et al.
2006 International Building Code, Section 712 Penetrations, 2006, 4 pages.
BXUV.GuideInfo, Fire Resistance Ratings—ANSI/UL 263, UL Online Certifications Directory, last updated Nov. 3, 2016, 27 pages.
CEYY.GuideInfo, Outlet Boxes and Fittings Certified for Fire Resistance, UL Online Certifications Directory, last updated May 16, 2013, 2 pages.
Canadian Office Action dated Dec. 23, 2013 from Canadian Application No. 2,778,581, 3 pages.
Canadian Office Action dated Mar. 22, 2016 from Canadian Application No. 2,879,629, 4 pages.
Canadian Office Action dated Dec. 6, 2016 from Canadian Application No. 2,879,629, 3 pages.
Canadian Office Action dated Mar. 9, 2017 from Canadian Application No. 2,931,588, 5 pages.
Canadian Office Action dated Feb. 1, 2016 from Canadian Application No. 2,879,486, 5 pages.
Canadian Office Action dated Jun. 12, 2017 from Canadian Application No. 2,927,601, 4 pages.
Canadian Office Action dated Aug. 11, 2017 from Canadian Application No. 2,941,051, 4 pages.
DMF, Inc., "dmfLIGHTING: LED Recessed Lighting Solutions," Info sheets, Mar. 15, 2012, 4 pages.
DMF, Inc., "dmfLIGHTING: LED Recessed Downlighting," DRD2 Product Brochure, Oct. 23, 2014, 50 pages.
DMF, Inc., "dmfLIGHTING: LED Recessed Downlighting," Product Catalog, Aug. 2012, 68 pages.
DME Series Installation Instructions, Oct. 18, 2011, 2 pages.
Final Office Action dated Apr. 27, 2016 from U.S. Appl. No. 14/184,601, 19 pages.
Final Office Action dated Jul. 26, 2017 from U.S. Appl. No. 14/184,601, 18 pages.
Final Office Action dated Jan. 29, 2016 from U.S. Appl. No. 14/183,424, 21 pages.
Final Office Action dated Jun. 23, 2016 from U.S. Appl. No. 13/484,901, 18 pages.
Final Office Action dated Apr. 2, 2015 from U.S. Appl. No. 13/484,901, 13 pages.
Halo, Halo LED H4 H7 Collection, SustainabLEDesign, Cooper Lighting, (emphasis on p. 18 "H7 Collection LED Modules—Halo LED H7 Module Features,") Mar. 28, 2012, 52 pages.
Halo, H7 LED Downlight Trims 49x Series, 6-inch LED Trims for Use with MI7x LED Modules, Cooper Lighting, ADV110422, rev. Aug. 12, 2011, 15 pages.
Halo, LED Module ML706x, Cooper Lighting, General Installation for All Modules/p. 1; Tether Installation/pp. 2-3; Installation into Halo H750x Series LED—only (Non-Screw Based), Recessed Fixture, p. 4, Oct. 20, 2009, 4 pages.
"Membrane Penetrations in Fire-Resistance Rated Walls," https://www.ul.com/wp-content/uploads/2014/04/ul_MembranePenetrations.pdf, Issue 1, 2009, 2 pages.
"Metallic Outlet Boxes," UL 514A, Underwriters Laboratories, Inc., Feb. 16, 2004 (Title Page Reprinted Aug. 10, 2007), 106 pages.
"Metallic and Non-metallic Outlet Boxes Used in Fire-rated Assembly," https://iaeimagazine.org/magazine/2000/09/16/metallic-and-non-metallic-outlet-boxes-used-in-fire-rated-assembly/, Sep. 16, 2000, 5 pages.
Non-Final Office Action dated Mar. 15, 2010 from U.S. Appl. No. 12/100,148, 8 pages.
Non-Final Office Action dated Apr. 30, 2010 from U.S. Appl. No. 12/173,232, 13 pages.
Non-Final Office Action dated Sep. 5, 2014 from U.S. Appl. No. 13/791,087, 8 pages.
Non-Final Office Action dated Jul. 20, 2015 from U.S. Appl. No. 14/184,601, 16 pages.
Non-Final Office Action dated Dec. 15, 2016 from U.S. Appl. No. 14/184,601, 18 pages.

(56) References Cited

OTHER PUBLICATIONS

Non-Final Office Action dated Feb. 6, 2018 from U.S. Appl. No. 15/167,682, 9 pages.
Non-Final Office Action dated Sep. 15, 2015 from U.S. Appl. No. 13/484,901, 16 pages.
Non-Final Office Action dated Oct. 16, 2014 from U.S. Appl. No. 13/484,901, 11 pages.
Non-Final Office Action dated Sep. 6, 2017 from U.S. Appl. No. 14/726,064, 8 pages.
Non-Final Office Action dated May 17, 2017 from U.S. Appl. No. 14/183,424, 20 pages.
Non-Final Office Action dated Jun. 2, 2015 from U.S. Appl. No. 14/183,424, 20 pages.
Non-Final Office Action dated Apr. 12, 2018 for U.S. Appl. No. 29/638,259, 5 pages.
Notice of Allowance dated Jan. 30, 2015 from U.S. Appl. No. 13/791,087, 9 pages.
Notice of Allowance dated Jan. 16, 2015 from U.S. Appl. No. 29/467,026, 9 pages.
Notice of Allowance dated Oct. 21, 2016 from U.S. Appl. No. 13/484,901, 7 pages.
Notice of Allowance dated Mar. 24, 2016 from U.S. Appl. No. 14/247,149, 8 pages.
Notice of Allowance dated Mar. 26, 2018 for U.S. Appl. No. 14/184,601, 10 pages.
Notice of Allowance dated Aug. 23, 2017 from Canadian Application No. 2,879,629, 1 page.
"Outlet Boxes for Use in Fire Rated Assemblies," https://www.ul.com/wp-content/uploads/2014/04/UI_outletboxes.pdf, 2011, 2 pages.
U.S. Appl. No. 29/645,941, filed Apr. 30, 2018, Danesh et al.

* cited by examiner

ALTERNATE JUNCTION BOX AND ARRANGEMENT FOR LIGHTING APPARATUS

BACKGROUND

The inventions of the present applicant such as those described in U.S. Pat. No. 9,581,302 and U.S. Patent Publ. Nos. 2017/0045213, 2016/0312987, 2016/0348861, 2016/0348860 and 2015/0276185, the contents of which are incorporated herein by reference in their entirety, have dramatically advanced the state of the art of lighting technology. However, opportunities for further improvements remain.

TECHNICAL FIELD

The present embodiments relate generally to lighting, and more particularly to an apparatus for a downlight or ceiling lamp incorporating an LED lighting source.

SUMMARY

Embodiments are directed to a lighting system including a junction box for accommodating a light source assembly, and which is configured to allow for additional components such as separate drivers or emergency ballasts to also be included in the lighting system together with the light source assembly. In embodiments, the junction box is mounted on a pan style frame. In some embodiments, the lighting system includes a test switch mounted on a trim piece that is accessible from below a ceiling in which the lighting system is installed, and which allows for an emergency power supply for the lighting system to be verified.

BRIEF DESCRIPTION OF THE DRAWINGS

The patent or application file contains at least one drawing executed in color. Copies of this patent or patent application publication with color drawing(s) will be provided by the Office upon request and payment of necessary fee.

These and other aspects and features of the present embodiments will become apparent to those ordinarily skilled in the art upon review of the following description of specific embodiments in conjunction with the accompanying figures, wherein.

DETAILED DESCRIPTION

The present embodiments will now be described in detail with reference to the drawings, which are provided as illustrative examples of the embodiments so as to enable those skilled in the art to practice the embodiments and alternatives apparent to those skilled in the art. Notably, the figures and examples below are not meant to limit the scope of the present embodiments to a single embodiment, but other embodiments are possible by way of interchange of some or all of the described or illustrated elements. Moreover, where certain elements of the present embodiments can be partially or fully implemented using known components, only those portions of such known components that are necessary for an understanding of the present embodiments will be described, and detailed descriptions of other portions of such known components will be omitted so as not to obscure the present embodiments. In the present specification, an embodiment showing a singular component should not be considered limiting; rather, the present disclosure is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present embodiments encompass present and future known equivalents to the known components referred to herein by way of illustration.

As set forth above, the present applicant has developed several innovations that have dramatically advanced the state of the art of lighting technology. For example, the innovation of U.S. Patent Publ. No. 2016/0312987 is directed to an outer casing and mounting hardware for a recessed lighting fixture that can allow a unified light source and driver module to be adjustably installed behind a ceiling (i.e. the outer casing housing the light source module can be adjustably mounted in different directions with respect to an opening in the ceiling). According to certain aspects, the present applicant has recognized that this and other innovations can be leveraged in certain ways, for example to allow for additional components such as separate drivers or emergency ballasts, to also be included in the light fixture along with the light source module.

Figure 1A:
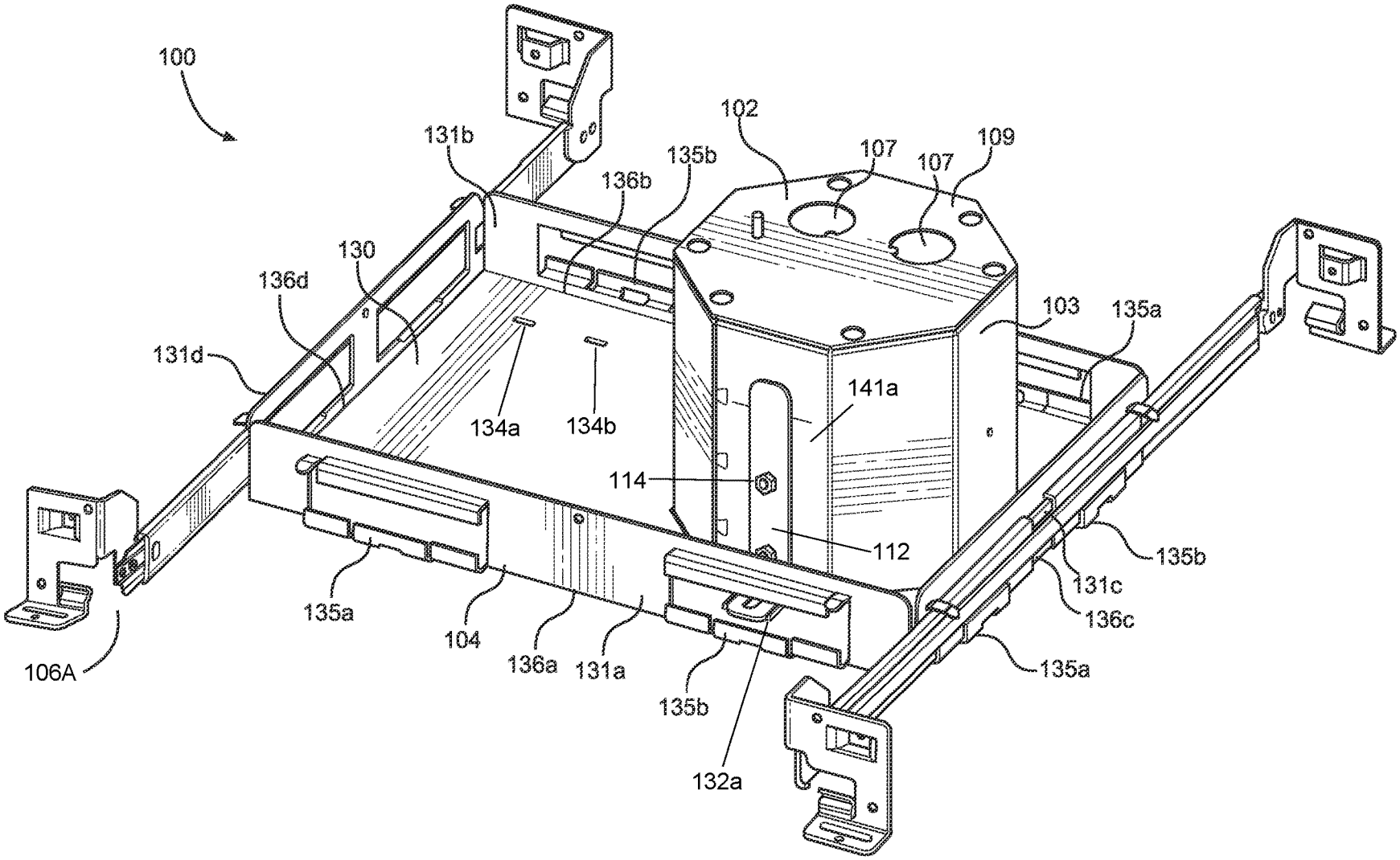
FIGS. 1A to 1C are various views of an example lighting system according to the embodiments.

In fulfillment of these and other aspects, FIG. 1A illustrates an example lighting system 100 according to the present embodiments.

As shown, lighting system 100 is comprised of a junction box 102 mounted on a frame 104. In embodiments, junction box 102 may be made of steel, stainless steel, aluminum, plastic, titanium, copper or nickel. Junction box 102 may be fire-resistant in that it has a fire rating of up to two hours without any need for modification, where the fire rating is described in the National Electrical Code (NEC) and by the Underwriters Laboratories (UL) such as specified in UL 263 Standard for Fire Tests of Building Construction and Materials. In other embodiments, lighting system 100 may include a standard 4×4 electrical junction box, which may or may not be fire rated. Moreover, although junction box 102 shown in the example of FIG. 1A as having an octagonal outer shape, this is not necessary. In other embodiments, junction box 102 may have any suitable shape, such as square, rectangle, pentagon, hexagon, heptagon, nonagon, or decagon, or having a rounded shape such as cylindrical, ellipsoid, frusto-conical, or otherwise curved shape. Example aspects of junction box 102 in some embodiments can be found in U.S. Patent Publ. No. 2016/0312987, the contents of which are incorporated herein by reference in their entirety.

Frame 104 is in the form of a pan or tray and may be comprised of steel, stainless steel, aluminum, plastic, titanium, copper or nickel. As further shown, frame 104 is attached to hangar bars 106A and 106B to allow the lighting system to be installed in a typical drop ceiling as will be described in more detail below. Moreover, as further shown, frame 104 is dimensioned to accommodate additional lighting system components other than junction box 102 according to additional aspects of other embodiments to be described in more detail below.

Figure 1B:
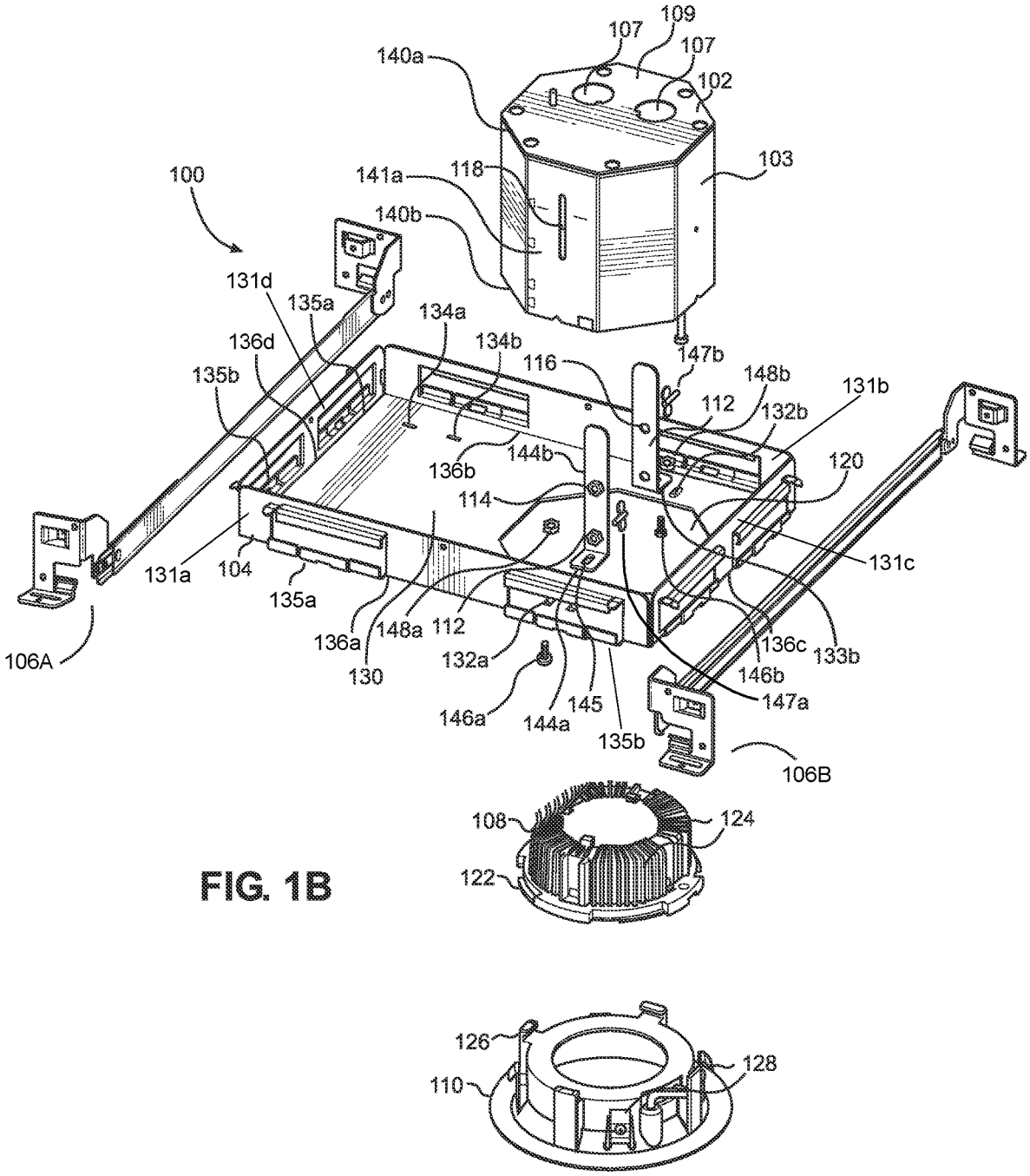
Figure 4A:
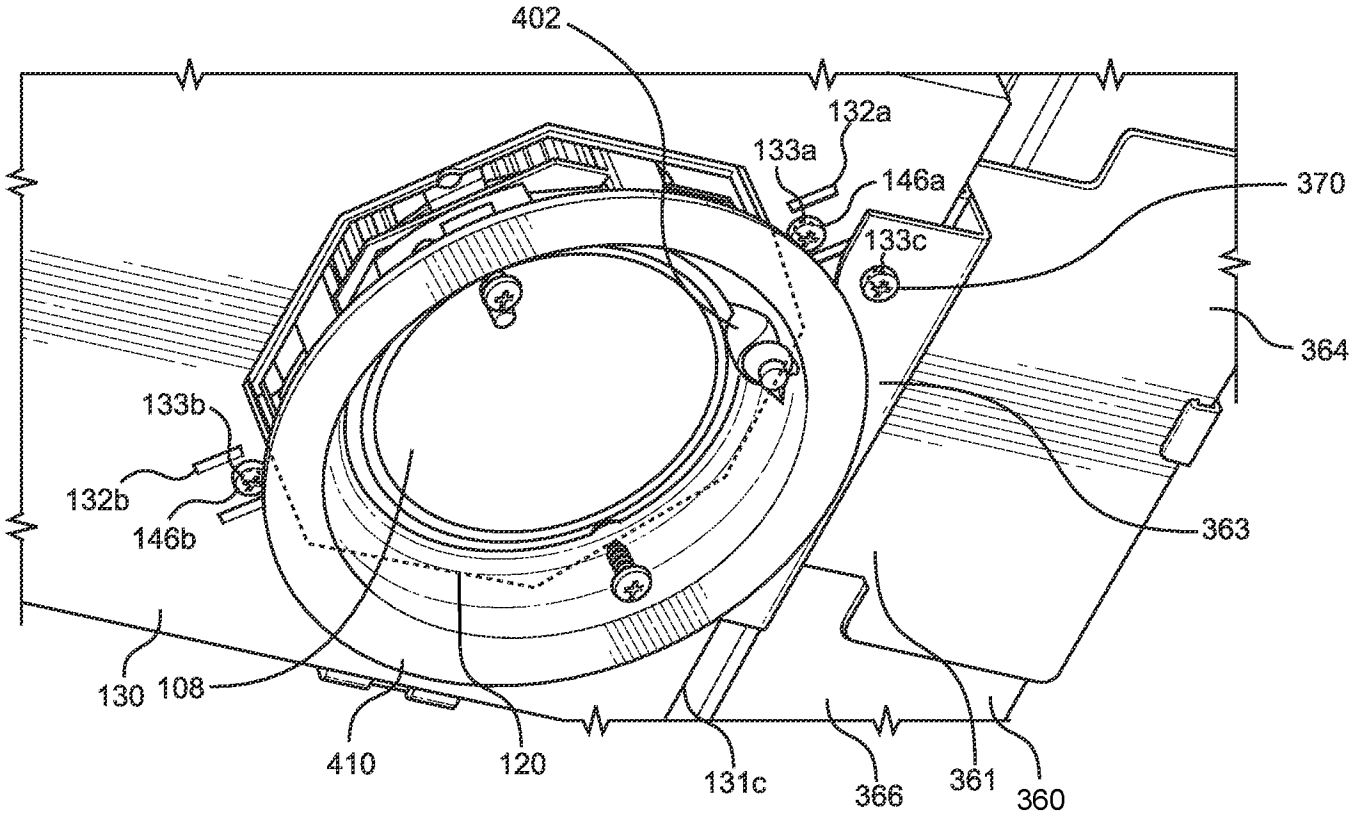
FIGS. 4A and 4B illustrates example emergency aspects of a lighting system such as that illustrated in FIG. 3.

FIG. 1B is an exploded view of example lighting system 100 according to the embodiments. FIGS. 1A and 1B show the frame 104 includes a bottom portion 130 shaped as a rectangle with side portions 131*a* and 131*b* formed along long edges 136*a* and 136*b* of the bottom portion 130, respectively. Side portions 131*c* and 131*d* formed along short edges 136*c* and 136*d*, respectively. Each of the side portions 131*a*-131*d* includes hanger bar guides 135*a* and 135*b*, which allow the respective pairs of hanger bars 106 to be mounted on either the long edges 136*a* and 136*b* or the short edges 136*c* and 136*d*. As shown in FIG. 1B, the bottom portion 130 of the frame 104 includes an opening 120 disposed closer to the short edge 136*c* than the short edge 136*d* to accommodate the junction box 102. The bottom portion 130 of the frame 104 further includes a pair of slots 134*a* and 134*b* to couple an external housing 261 (see FIG. 2) to the frame 104. The slots 134*a* and 134*b* are colinearly aligned and disposed closer to the short edge 136*d* than the short edge 136*c* as shown in FIG. 1B. FIG. 1B also shows the bottom portion 130 of the frame 104 includes two pairs of bracket guides 132*a* and 132*b* disposed near the opening 120 and opposite with respect to one another. The pairs of brackets guides 132*a* and 132*b* constrain corresponding L-shaped brackets 112 when coupling the L-shaped brackets 112 to the frame 104. FIG. 4A shows the bottom portion 130 of the frame 104 further includes fastener opening 133*a* disposed partially between the pair of bracket guides 132*a* and the opening 120 to receive a fastener 146*a*, FIG. 1B also shows this fastener 146*a* as well as a nut 148*a* to securely couple one L-shaped bracket 112 to the frame 104. Similarly, FIGS. 1B and 4A show the bottom portion 130 also includes a fastener opening 133*b* disposed partially between the pair of bracket guides 132*b* and the opening 120 to receive a fastener 146*b* and a nut 148*b* to securely couple the other L-shaped bracket 112 to the frame 104. FIG. 4A also shows the bottom portion 130 includes a fastener opening 133*c* disposed between the opening 120 and the short edge 136*c* to support a ballast support bracket 361.

The junction box 102 may have a side wall 103 that extends from and is joined at its upper edge (or upper end) 140*a* to a closed base end 109, which together define a cavity 105 therein. The side wall 103 may surround the cavity 105, with its lower edge (or lower end) 140*b* defining the perimeter of an opening 111 through which various components can be placed inside the cavity 105, including for example, a ring, the light source assembly 108, and the trim 110. The cavity 105 that is formed in the junction box 102 is larger than the outside dimensions of the light source assembly 108 such that the entirety of the light source assembly 108 fits into the cavity 105. The light source assembly 108 may or may not come into direct contact with the side wall 103 of the junction box 102.

The junction box 102 may have on its base end one or more knockouts 107 as shown. The knockouts 107 may be punched through and removed to leave an opening behind on the base end, for electrical wires to be inserted through the opening. One or more knockouts 107 may also have smaller openings in them (e.g., a slit, slot, etc., that is smaller than the opening that results when the knockout 107 has been removed from the base end) that may allow the electrical wires to be inserted through without the need to punch through the knockouts 107. The knockout 107 may be more than ½ inch in diameter. In one embodiment, one or more of the knockouts 107 allow for the installation therethrough of a non-metallic sheathed cable. One or more of the knockouts 107 may also be positioned on the side wall 103 of the junction box 102.

As can be seen in more detail in this view, junction box 102 is attached to frame 104 by a pair of brackets 112 and nuts 114 (e.g. wing nuts). Each bracket 112 is a L-shaped bracket with a first arm 144*a* and a second arm 144*b* oriented at a right angle with respect to the first arm 144*a*. The first arm 144*a* includes a fastener opening 145, which aligns with the fastener opening 133*a* (see FIG. 4A) to receive the screw fastener 146*a*. The second arm 144*b* includes a fastener opening 116 (also referred to as a through hole 116, see FIG. 1B), which aligns with the slot 118 on the junction box 102. Nuts 114 engage with screws (e.g., see wing fasteners 147*a* and 147*b* in FIG. 1B) that extend both through holes 116 of brackets 112 and slots 118 in housing 102 (e.g., see slots 118 formed on the first side 141*a* and the second side 141*b* of the side wall 103 in FIGS. 1B and 1C). With such slots 118 and corresponding fastening mechanisms 114 etc., junction box 102 may be slidably repositioned to extend through opening 120 of frame 104 as will be described in more detail below. Another aspect of the example illustrated fasteners between frame 104 and junction box 102 is that they allow for junction box 102 to be selectively removed from frame 104, for example for servicing or replacement of components.

As shown, lighting system 100 further includes light source assembly 108 and trim 110 that can be mounted together to housing 102. As will be described in more detail below, when assembled together, the lighting system 100 is designed to be positioned behind a ceiling or a wall such that the trim 110 extends outside a hole in the ceiling or wall (not shown) and rests flush against the exposed surface of the ceiling or wall.

In this example embodiments, light source assembly 108 is comprised of a housing that includes integrally formed flange portion 122 and fins 124. The housing may be composed of any thermally conductive material so as to help cool the light source assembly 108 during operation. For example, the housing of light source assembly 108 including integrally formed flange portion 122 and fins 124 may be comprised of injection molded thermally conductive plastic. In other embodiments, the housing may be made of aluminum alloys, copper, copper-tungsten pseudoalloy, AlSiC (silicon carbide in aluminum matrix), Dymalloy (diamond in copper-silver alloy matrix), E-Material (beryllium oxide in beryllium matrix), and/or other thermally conductive plastics or ceramics.

Although not shown in detail in FIG. 1B, light source assembly 108 in example embodiments can include an integrated driver such as an electronic circuit or device that supplies and/or regulates electrical energy to a light source and thus power the light source to emit light. This can include any type of power supply circuit, including one that includes power converters, rectifiers, power transistors and the like for delivering an appropriate alternating current (AC) or a direct current (DC) voltage to the light source. Upon receiving electricity, the power supply circuit may regulate current or voltage to supply a stable voltage or current within the operating parameters of the light source. In embodiments, the power supply circuit receives an input current from an electrical power wiring network of the building or structure in which the lighting system 100 is installed, and may drop the voltage of the input current to an acceptable level for the light source (e.g., from 120V-277V to 36V-48V). In these and other embodiments, junction box 102 may include appropriate wiring and other components to allow for such electrical connections. These electrical connections preferably include keyed or interlocking connectors (not shown) within junction box 102 that allow light source assembly 108 to receive power from the electrical power wiring network. Such keyed or interlocking connectors are further preferably configured to allow for manual connection or disconnection without the use of tools.

The light source in light source assembly 108 may be any electro-optical device or combination of devices for emitting light. For example, the light source may have one or more light emitting diodes (LEDs, such as an XLamp LED from Cree), organic light-emitting diode (OLEDs), or polymer light-emitting diode (PLEDs). An example embodiment of light source assembly 108 having an integrated driver that can be used in lighting system 100 of FIG. 1B is described in more detail in U.S. Patent Publication No. 2015/0009676, the contents of which are incorporated herein by reference in their entirety. It should be noted that an integrated driver is not necessary in all embodiments, as will become more apparent below.

In the illustrated example, trim 110 is attached to the flange portion 122 of light source assembly 108 by mutually engaging twist and lock mechanisms 126 built onto trim 110 and inner surface of flange portion 122. When trim 110 and light source assembly 108 are thus joined together, the attached components can then be installed into junction box 102 in a friction fit manner by clips 128 extending from trim 110.

Figure 1C:
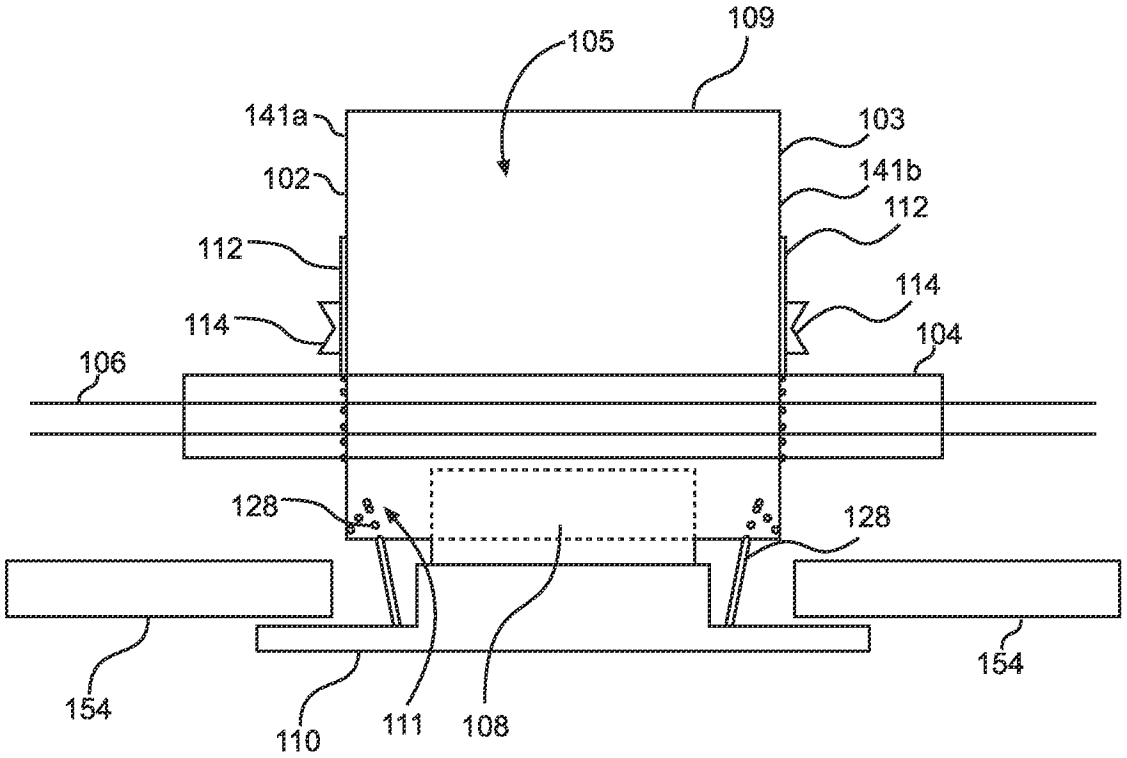

FIG. 1C illustrates aspects of how embodiments of lighting system 100 can be used to provide a downlight in a ceiling.

As shown, frame 104 of lighting system 100 is secured above an opening in ceiling 154 (e.g. to joists or other structures in a drop ceiling) by hanger bars 106. Junction box 102 is mounted to frame 104 above the opening of ceiling 154 by brackets 112, screws 147*a* and 147*b* and nuts 114. As described above, light source assembly 108 and trim 110 are coupled together via a twist and lock mechanism and these two components are jointly connected to junction box 102 using clips 128 on trim 110. When light source assembly 108 and trim 110 are thus secured to junction box 102, trim 110 is flush against the surface of ceiling 154, and trim 110 is the only portion of the lighting system 100 that extends outward from the surface of ceiling 154. As further described above, by virtue of slots 118 in junction box 102, junction box 102 can be slidably repositioned to allow trim 110 to be as flush as desirable against the surface of ceiling 154, or otherwise desirably positioned within the opening of ceiling 154, depending on the style and form of trim 110.

In addition to these aesthetically desirable aspects, additional functionally desirable aspects are made possible by lighting system 100 as well. For example, after installation of junction box 102 behind ceiling 154, light source assembly 108 and trim 110 can be freely installed or otherwise accessed from below the ceiling line, without needing to access the space above the ceiling line. For example, after installation into junction box 102, by manipulation of clips 128, light source assembly 108 and trim 110 can be removed. As described above, light source assembly 108 can further be manually disconnected from a power source when junction box 102 includes suitable electrical wiring connectors. After light source assembly 108 and trim 110 are removed, either or both of them can be serviced and replaced, all without the need for accessing junction box 102 or the space behind ceiling 154.

Figure 2:
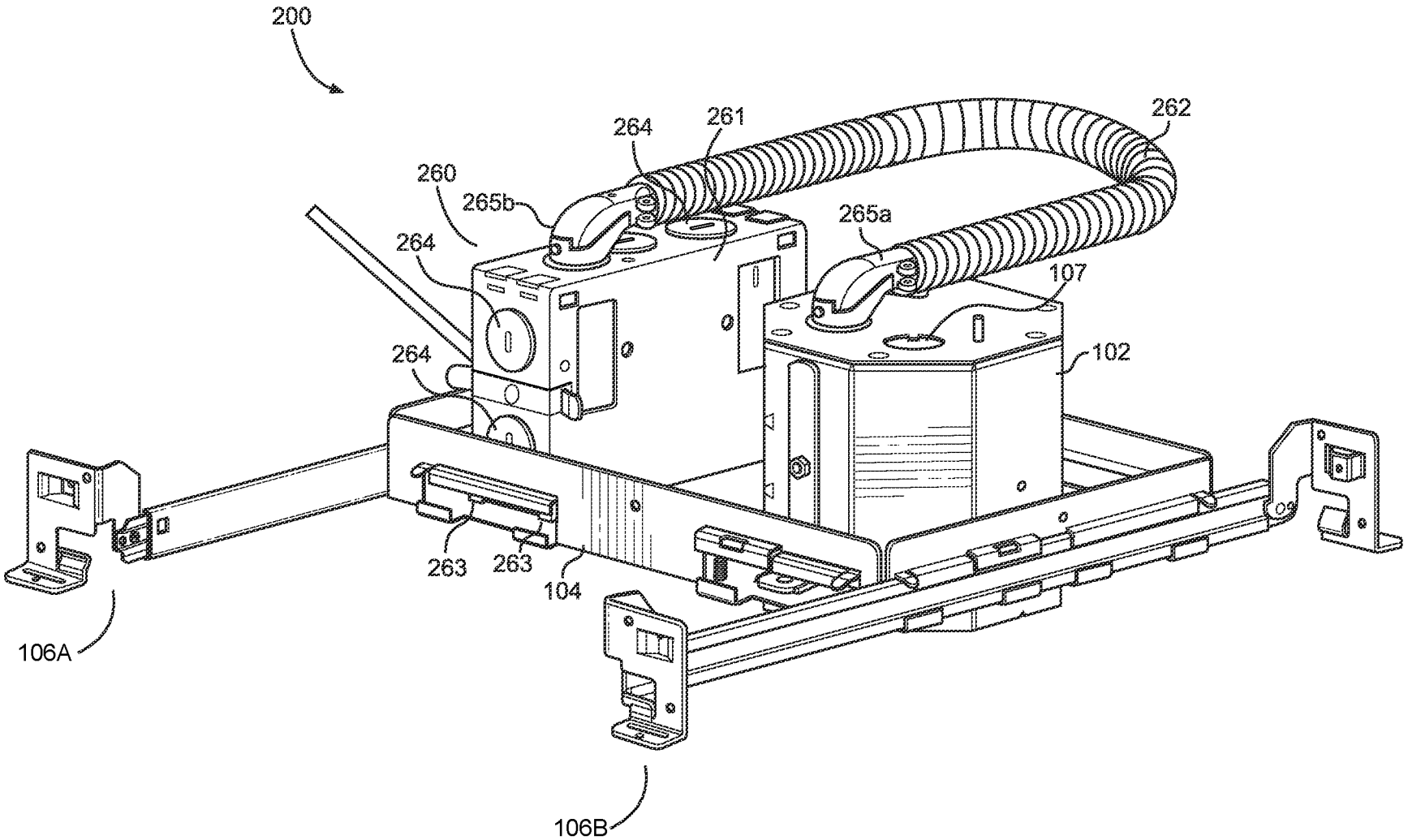
FIG. 2 illustrates another example lighting system according to the embodiments.

FIG. 2 illustrates another example of a lighting system 200 according to alternative embodiments.

As shown in this example, lighting system 200 includes many of the same components as lighting system 100, and so repeated descriptions thereof are not included here. Meanwhile, lighting system 200 further includes driver 260. This embodiment can be useful when light source assembly 118 (not shown) does not include a unified driver as described above in connection with lighting system 100. This can provide some benefits in some environments, such as lowering thermal extremes in connection with light source assembly 118, and providing for a distribution of heat among components 102, 260.

Similarly as described above, driver 260 can include any type of power supply circuit, including one that includes power converters, rectifiers, power transistors and the like for delivering an appropriate alternating current (AC) or a direct current (DC) voltage to the light source. Upon receiving electricity, the power supply circuit may regulate current or voltage to supply a stable voltage or current within the operating parameters of the light source in lighting assembly 118. In lighting system 200, driver 260 receives an input current from an electrical power wiring network of the building or structure in which the lighting system 200 is installed via junction box 102 and one or more wires in conduit 262. Driver 260 may drop the voltage of the input current to an acceptable level for the light source (e.g., from 120V-277V to 36V-48V) and provide the regulated voltage back to the light source in junction box 102 via one or more additional wires in conduit 262.

In embodiments, driver 260 may include an external housing 261 made of galvanized steel, injection molded plastic, titanium, aluminum, stainless steel, copper or nickel. As such, similarly to junction box 102, driver 260 may be fire-resistant in that it has a fire rating of up to two hours without any need for modification, where the fire rating is described in the National Electrical Code (NEC) and by the Underwriters Laboratories (UL) such as specified in UL 263 Standard for Fire Tests of Building Construction and Materials. FIG. 2 further shows the external housing 261 includes a plurality of knockouts 264 and a plurality of tabs 263 inserted through corresponding slots formed on the bottom portion 130 of the frame 104 (e.g., slots 134*a* and 134*b* as shown in FIG. 1B). FIG. 2 also shows the conduit 262 has a first end 265*a* coupled to the junction box 102 via an opening formed by the removal of one of the knockouts 107 and a second end 265*b* coupled to the external housing 261 via an opening formed by the removal of one of the knockouts 264. In these and other embodiments, conduit 262 may be flexible metal conduit having a UL rating.

Figure 3:
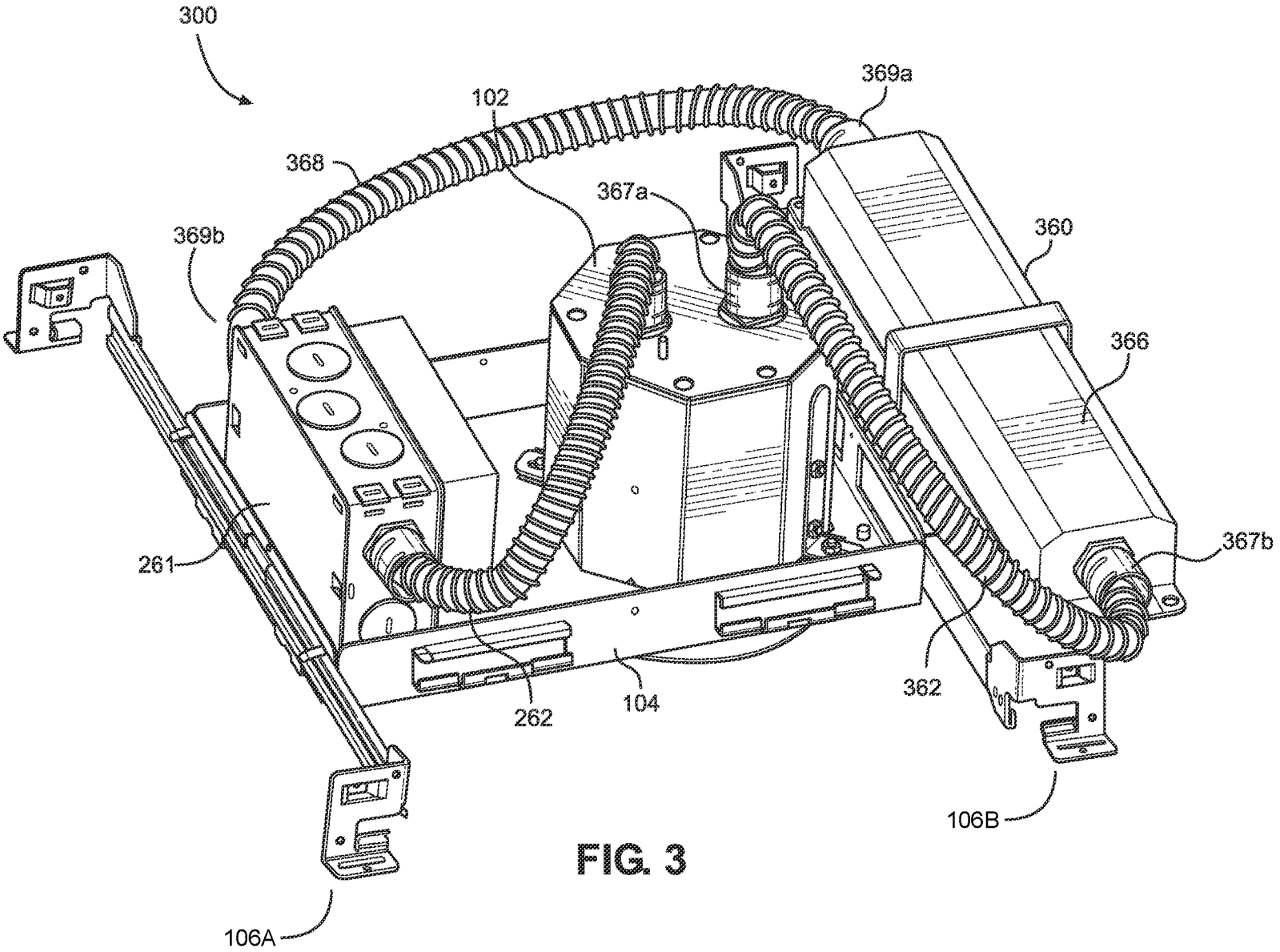
FIG. 3 illustrates another example lighting system according to the embodiments.

FIG. 3 illustrates another example of a lighting system 300 according to alternative embodiments.

As shown in this example, lighting system 300 includes many of the same components as lighting systems 100 and 200, and so repeated descriptions thereof are not included here. Meanwhile, lighting system 300 further includes an emergency ballast 360.

In embodiments, emergency ballast 360 includes batteries that allow for the continued operation of the light source in light source assembly 108 when electrical power in the building in which lighting system 300 is installed is interrupted or otherwise absent. In these and other embodiments, driver 260 and/or emergency ballast 360 may include relays, switches and similar circuitry for automatically switching the supply of electrical power to light source assembly 108 to be provided from the batteries instead of the building electrical power network during such interruptions via conduit 362. Additionally or alternatively, driver 260 and/or emergency ballast 360 may include converters, regulators, and similar circuitry for automatically charging the batteries via conduit 368 using power received from the building electrical power network when it is not interrupted. The circuitry described herein can be implemented using many ways known to those skilled in the art, and so details thereof will be omitted here for sake of clarity of the invention.

Similar to driver 260, in embodiments, emergency ballast 360 may include an external housing 366 made of galvanized steel, injection molded plastic, or ceramic. As such, similarly to junction box 102 and driver 260, emergency ballast 360 may be fire-resistant in that it has a fire rating of up to two hours without any need for modification, where the fire rating is described in the National Electrical Code (NEC) and by the Underwriters Laboratories (UL) such as specified in UL 263 Standard for Fire Tests of Building Construction and Materials. FIG. 4A shows the ballast 360 is coupled to the frame 104 via a ballast support bracket 361. The ballast support bracket 361 includes a base portion 363 coupled to the bottom portion 130 of the frame 104 via a fastener 370 inserted, in part, through the fastener opening 133*c* on the bottom portion 130. In FIG. 4A, the trim 110 obscures view of a second fastener inserted through a second fastener opening on the bottom portion 130 of the frame 104 to couple the ballast support bracket 361 to the frame 104. The ballast support bracket 361 further includes a platform 364 connected to the base portion 363 that extends laterally from the short edge 131*c* of the frame 104 to support the external housing 366. FIG. 3 also shows the conduit 362 has a first end 367*a* coupled to the junction box 102 via an opening formed by the removal of one of the knockouts 107 and a second end 367*b* coupled to the external housing 366. FIG. 3 also shows the conduit 368 has a first end 369*a* coupled to the external housing 366 and a second end 369*b* coupled to the external housing 261. In these and other embodiments, conduits 362 and 368 may be flexible metal conduit having a UL rating.

Although not shown in detail in FIG. 3, frame 104 of lighting system 300 can include a release mechanism(s) for allowing emergency ballast 360 and/or driver 260 to be easily detached from frame 104 for servicing and/or replacement for example.

FIG. 4A shows an example emergency switch that can be used in together with a lighting system 300 such as that shown in FIG. 3 and described above.

As shown in this example, trim 410 of lighting system 300 includes test button 402. Test button 402 can be connected to an electrical wire (not shown) and electrical signal source and can include any electrical and mechanical components so that, when test button 402 is depressed, an electrical signal is provided on the attached electrical wire and provided to driver 260 and/or emergency ballast 360, and used to test the battery power in emergency ballast 360 as will be described in more detail below.

Figure 4B:
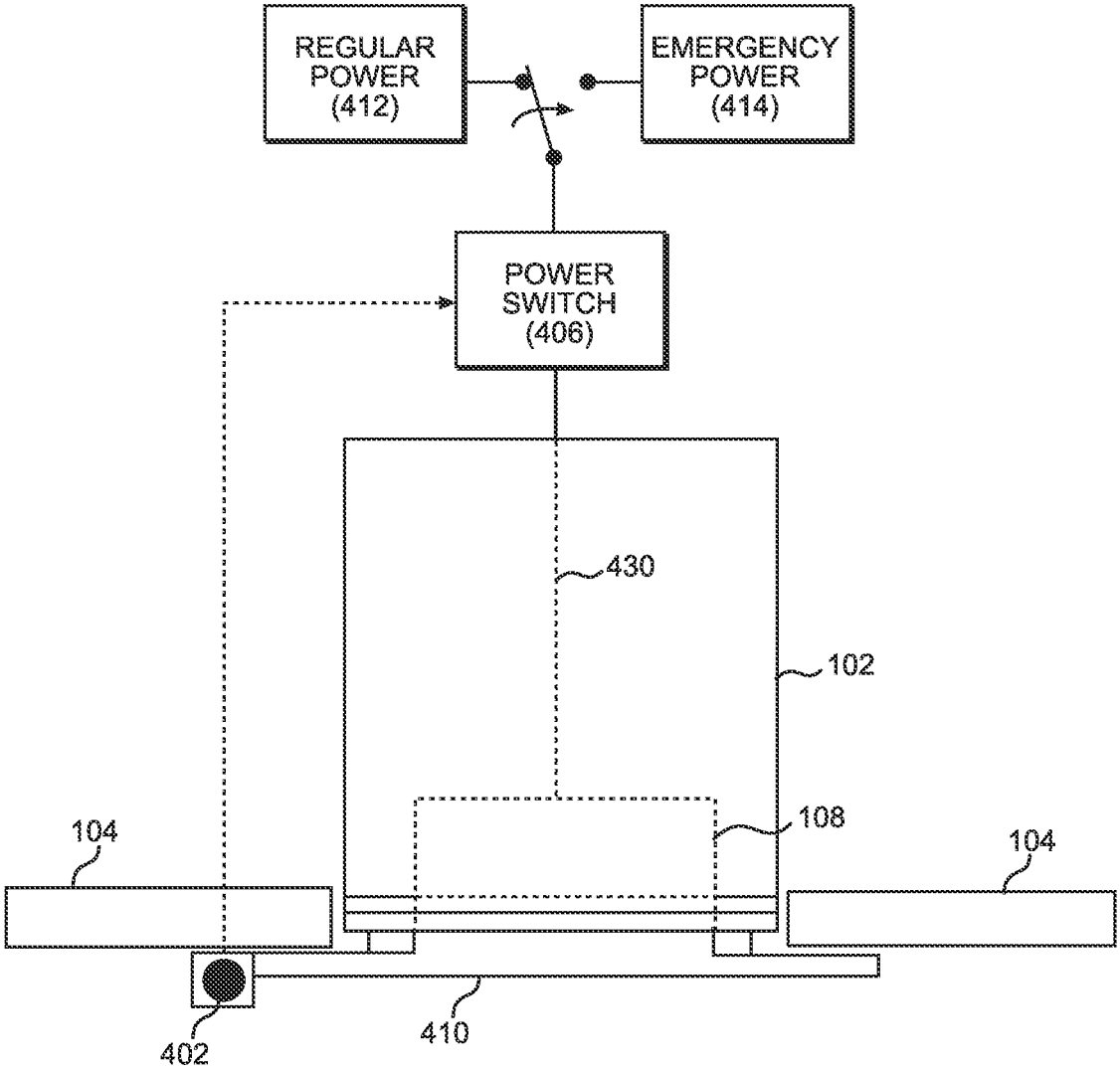

FIG. 4B illustrates example emergency aspects of lighting system 300 having a test button 402. In this example, lighting system 300 is mounted behind a ceiling 104 as described above in connection with FIG. 1C. As such, when lighting system 300 having trim 410 is so installed, button 402, by virtue of being attached to trim 410, is accessible from below ceiling 104. As further illustrated, when button 402 is pressed, an electrical signal is sent to power switch 406 (e.g. in driver 260 or emergency ballast 360), which causes power to the light source assembly 108 (e.g. via wire(s)/connector(s) 430 routed from the test switch 402 to power switch 406) to be switched from regular power source 412 (e.g. a building electrical wiring network) to an emergency power source 414 (e.g. batteries in emergency ballast 360). If the power in the batteries is sufficient, light from light source assembly 108 will be produced, thereby allowing personnel to verify emergency power source 414 without having to remove lighting system 300 from behind the ceiling or otherwise gain direct access to emergency power source 414.

It should be noted that embodiments are not limited to systems 100, 200 and 300 described herein, and that systems 100, 200 and 300 are not necessarily mutually exclusive. For example, according to certain aspects, the same frame 104 installed in a single building location can accommodate certain components at one time (i.e. some combination or all of junction box 102, driver 260 and ballast 360), and other combinations of components at another time. Additionally or alternatively, any or all of such components can be freely serviced and/or replaced with similar components at any given point in time.

Although the present embodiments have been particularly described with reference to preferred ones thereof, it should be readily apparent to those of ordinary skill in the art that changes and modifications in the form and details may be made without departing from the spirit and scope of the present disclosure. It is intended that the appended claims encompass such changes and modifications.

What is claimed is:

1. A lighting apparatus, comprising:

a junction box, comprising:

a base end having a plurality of knockouts; and a side wall, comprising:

a first end joined to the base end such that the side wall and the base end together define a cavity;

a second end that defines an opening to the cavity, the cavity being configured to at least partially contain therein a light source through the opening of the cavity; and a side wall portion having a slot;

a frame mechanically coupled to the junction box, the frame being in the form of a tray, the frame comprising:

a bottom portion, comprising:

a frame opening to accommodate at least a portion of the junction box; and a pair of bracket guides disposed proximate to the frame opening;

an L-shaped bracket to couple the junction box to the frame, the L-shaped bracket comprising:

a first arm mechanically constrained by the pair of bracket guides; and a second arm coupled to the slot of the junction box, the second arm being integrally formed with the first arm and oriented at a right angle with respect to the first arm; and a first pair of hanger bars, connected to the frame, to mount the lighting apparatus behind one of a ceiling or a wall, wherein the junction box is slidably repositionable with respect to the frame through the frame opening via the slot.

2. The lighting apparatus of claim 1, further comprising:

the light source comprising one or more LEDs;

a driver for the light source housed within the junction box; and electrical connectors, disposed within the cavity of the junction box, to connect the driver to a power source.

3. The lighting apparatus of claim 2, wherein the power source comprises one or both of a building power supply network and a battery in a ballast.

4. The lighting apparatus of claim 1, wherein:

the bottom portion of the frame further comprises a first fastener opening at least partially disposed between the pair of bracket guides and the frame opening;

the L-shaped bracket further comprises a second fastener opening disposed on the first arm and aligned with the first fastener opening of the frame; and the lighting apparatus further comprises a screw fastener, inserted through the first and second fastener openings, to couple the L-shaped bracket to the bottom portion of the frame.

5. The lighting apparatus of claim 1, wherein:

the L-shaped bracket further comprises a first fastener opening disposed on the second arm and aligned with the slot of the junction box;

the lighting apparatus further comprises a wing screw, inserted through the first fastener opening and the slot, to couple the L-shaped bracket to the junction box; and the junction box is slidably repositionable with respect to the frame only when the wing screw is loosened.

6. The lighting apparatus of claim 1, wherein the side wall portion of the junction box is flat.

7. The lighting apparatus of claim 1, wherein the second arm of the L-shaped bracket abuts the side wall portion of the junction box.

8. The lighting apparatus of claim 1, wherein:

the frame further comprises:

a first side portion integrally formed with the bottom portion;

a first plurality of hanger bar guides at least partially formed on the first side portion;

a second side portion disposed opposite the first side portion and integrally formed with the bottom portion; and a second plurality of hanger bar guides at least partially formed on the second side portion;

the first plurality of hanger bars is slidably coupled to the frame via the first plurality of hanger bar guides; and the lighting apparatus further comprises a second plurality of hanger bars slidably coupled to the frame via the second plurality of hanger bar guides.

9. The lighting apparatus of claim 8, wherein:

the bottom portion of the frame is shaped as a rectangle with a first long edge, a second long edge opposite the first long edge, a first short edge, and a second short edge opposite the first short edge;

the first side portion is formed along the first long edge; and the second side portion is formed along the second long edge.

10. The lighting apparatus of claim 1, wherein the lighting apparatus further comprises an external housing, coupled to the bottom portion of the frame and disposed adjacent to the junction box, configured to contain at least a portion of a plurality of wires.

11. The lighting apparatus of claim 10, wherein:

the junction box has a first feedthrough opening formed by the removal of a first knockout of the plurality of knockouts;

the external housing has a second feedthrough opening formed by the removal of a second knockout; and the lighting apparatus further comprises:

a metal conduit having a first end coupled to the junction box via the first feedthrough opening and a second end coupled to the external housing via the second feedthrough opening; and the plurality of wires, at least partially disposed within the metal conduit, to transfer electrical power from the external housing to the junction box.

12. A lighting apparatus, comprising:

a junction box, comprising:

a base end having a plurality of knockouts; and a side wall, comprising:

a first end joined to the base end such that the side wall and the base end together define a cavity;

a second end that defines an opening to the cavity, the cavity being configured to at least partially contain therein a light source through the opening of the cavity;

a frame mechanically coupled to the junction box, the frame being in the form of a tray, the frame comprising:

a bottom portion having a frame opening to accommodate at least a portion of the junction box;

a first side portion integrally formed with the bottom portion;

a first plurality of hanger bar guides at least partially formed on the first side portion;

a second side portion disposed opposite the first side portion and integrally formed with the bottom portion; and a second plurality of hanger bar guides at least partially formed on the second side portion;

a first pair of hanger bars connected to the first side portion of the frame via the first plurality of hanger bar guides; and a second pair of hanger bars connected to the second side portion of the frame via the second plurality of hanger bar guides, the first and second pairs of hangers bars being used together to mount the lighting apparatus behind one of a ceiling or a wall when the lighting apparatus is installed, wherein:

the frame does not include a collar that protrudes from the bottom portion and partially surrounds the frame opening; and the bottom portion of the frame is disposed closest to the ceiling or the wall when the lighting apparatus is installed.

13. The lighting apparatus of claim 12, further comprising:

a test switch for causing power to be temporarily provided from a battery to the light source when the battery and the light source are present in the lighting apparatus, wherein the test switch is positioned to be accessible from below a ceiling line when the lighting apparatus is mounted behind the ceiling.

14. The lighting apparatus of claim 12, further comprising:

the light source comprising one or more LEDs;

a driver for the light source housed within the junction box; and electrical connectors that allow the driver to be connected to a power source.

15. The lighting apparatus of claim 12, wherein:

the bottom portion of the frame further comprises:

a first pair of bracket guides disposed proximate to the frame opening; and a second pair of bracket guides disposed proximate to the frame opening and diametrically opposite with respect to the first pair of bracket guides; and the lighting apparatus further comprises:

a first L-shaped bracket mechanically constrained by the first pair of bracket guides and coupled to the junction box; and a second L-shaped bracket mechanically constrained by the second pair of bracket guides and coupled to the junction box.

16. The lighting apparatus of claim 15, wherein:

the first L-shaped bracket is coupled to the junction box via a first wing screw;

the second L-shaped bracket is coupled to the junction box via a second wing screw; and the junction box is slidably repositionable with respect to the frame through the frame opening when the first and second wing screws are loosened.

17. The lighting apparatus of claim 12, wherein:

the bottom portion of the frame is shaped as a rectangle with a first long edge, a second long edge opposite the first long edge, a first short edge, and a second short edge opposite the first short edge;

the first side portion is formed along the first long edge; and the second side portion is formed along the second long edge.

18. The lighting apparatus of claim 12, wherein:

the bottom portion of the frame is shaped as a rectangle with a first long edge, a second long edge opposite the first long edge, a first short edge, and a second short edge opposite the first short edge;

the frame opening is disposed closer to the first short edge than the second short edge;

the bottom portion of the frame further comprises a plurality of slots disposed closer to the second short edge than the first short edge, closer to the second long edge than the first long edge, and in parallel alignment with the first long edge; and the lighting apparatus further comprises an external housing having a plurality of tabs that are each inserted through a corresponding slot of the plurality of slots to couple the external housing to the bottom portion of the frame, the external housing being configured to contain at least a portion of a plurality of wires.

19. The lighting apparatus of claim 18, wherein:

the junction box has a first feedthrough opening formed by the removal of a first knockout of the plurality of knockouts;

the external housing has a second feedthrough opening formed by the removal of a second knockout; and the lighting apparatus further comprises:

a metal conduit having a first end coupled to the junction box via the first feedthrough opening and a second end coupled to the external housing via the second feedthrough opening; and the plurality of wires, at least partially disposed within the metal conduit, to transfer electrical power from the external housing to the junction box.

20. The lighting apparatus of claim 12, wherein:

the bottom portion of the frame is shaped as a rectangle with a first short edge, a second short edge opposite the first short edge; and the lighting apparatus further comprises:

a ballast support bracket having a base portion directly coupled to the bottom portion of the frame and having a platform in parallel alignment with the bottom portion; and a ballast having an external housing coupled to the platform of the ballast support bracket, the external housing containing a plurality of batteries to supply electrical power to the junction box.

21. The lighting apparatus of claim 20, wherein:

the junction box has a first feedthrough opening formed by the removal of a first knockout of the plurality of knockouts; and the lighting apparatus further comprises:

a metal conduit having a first end coupled to the junction box via the first feedthrough opening and a second end coupled to the external housing; and a plurality of wires, at least partially disposed within the metal conduit, to transfer electrical power from the ballast to the junction box.

22. A lighting apparatus, comprising:

a junction box having a side wall, the side wall having a first end joined to a base end such that the side wall and the base end together define a cavity, the side wall having a second end that defines an opening of the cavity, the cavity being configured to at least partially contain therein a light source through the opening of the cavity, the junction box including a plurality of knockouts on at least one of the side wall or the base end;

a frame mechanically coupled to the junction box, the frame being in the form of a tray, the frame comprising:

a bottom portion, comprising:

a frame opening to accommodate at least a portion of the junction box;

a first pair of bracket guides disposed proximate to the frame opening; and a second pair of bracket guides disposed proximate to the frame opening and diametrically opposite with respect to the first pair of bracket guides;

a first L-shaped bracket mechanically constrained by the first pair of bracket guides and coupled to the junction box;

a second L-shaped bracket mechanically constrained by the second pair of bracket guides and coupled to the junction box;

a first external housing, disposed on the bottom portion of the frame adjacent to the junction box and coupled to the bottom portion of the frame, configured to contain at least a portion of a plurality of wires; and a pair of hanger bars connected to the frame by which the lighting apparatus can be mounted behind one of a ceiling and a wall.

23. The lighting apparatus of claim 22, further comprising:

the light source; and a driver disposed in the cavity of the junction box.

24. The lighting apparatus of claim 22, wherein:

the side wall of the junction box includes a first slot and a second slot disposed diametrically opposite with respect to the first slot;

the first L-shaped bracket is coupled to the first slot of the junction box via a first wing screw;

the second L-shaped bracket is coupled to the second slot of the junction box via a second wing screw; and the junction box is slidably repositionable with respect to the frame through the frame opening via the first and second slots when the first and second wing screws are loosened.

25. The lighting apparatus of claim 22, wherein:

a first knockout of the plurality of knockouts of the junction box is removed to form a first feedthrough opening; and the lighting apparatus further comprises:

a first metal conduit directly coupled to the junction box via the first feedthrough opening and directly coupled to the first external housing; and a first plurality of wires, at least partially disposed within the first metal conduit and inserted through the first feedthrough opening, to supply electrical power from the first external housing to the junction box.

26. The lighting apparatus of claim 25, wherein:

a second knockout of the plurality of knockouts is removed to form a second feedthrough opening; and the lighting apparatus further comprises:

a ballast, coupled to the frame, having a second external housing containing a plurality of batteries;

a second metal conduit directly coupled to the junction box via the second feedthrough opening and directly coupled to the second external housing; and a second plurality of wires, at least partially disposed within the second metal conduit and inserted through the second feedthrough opening, to supply electrical power from the plurality of batteries to the junction box.

27. The lighting apparatus of claim 26, further comprising:

a third metal conduit directly coupled to the first external housing and the second external housing; and a third plurality of wires, at least partially disposed within the third metal conduit, to supply electrical power from the building electrical power network to the ballast so as to charge the batteries of the ballast.

28. The lighting apparatus of claim 22, wherein:

the frame does not include a collar that protrudes from the bottom portion and partially surrounds the frame opening; and the bottom portion corresponds to the portion of the frame disposed closest to the ceiling or the wall when the lighting apparatus is installed behind the ceiling or the wall.

29. A lighting apparatus, comprising:

a junction box, comprising:

a base end having a plurality of knockouts; and a side wall, comprising:

a first end joined to the base end such that the side wall and the base end together define a cavity;

a second end that defines an opening to the cavity, the cavity being configured to at least partially contain therein a light source through the opening of the cavity when the light source is present;

a first side wall portion having a first slot; and a second side wall portion having a second slot disposed diametrically opposite with respect to the first slot;

a frame mechanically coupled to the junction box, the frame being in the form of a tray, the frame comprising:

a bottom portion shaped as a rectangle with a first long edge, a second long edge opposite the first long edge, a first short edge, and a second short edge opposite the first short edge, the bottom portion comprising:

a frame opening disposed closer to the first short edge than the second short edge;

a third slot disposed closer to the second short edge than the first short edge, closer to the second long edge than the first long edge, and in parallel alignment with the first long edge;

a fourth slot disposed between the third slot and the frame opening and colinearly aligned with the third slot;

a first pair of bracket guides disposed proximate to the frame opening; and a second pair of bracket guides disposed proximate to the frame opening and diametrically opposite with respect to the first pair of bracket guides;

a first side portion integrally formed with the bottom portion;

a first plurality of hanger bar guides at least partially formed on the first side portion and protruding outwards from the first side portion away from the junction box;

a second side portion integrally formed with the bottom portion; and a second plurality of hanger bar guides at least partially formed on the second side portion and protruding outwards from the second side portion away from the junction box;

a first L-shaped bracket, comprising:

a first arm mechanically constrained by the first pair of bracket guides; and a second arm, integrally formed with the first arm and oriented at a right angle with respect to the first arm, having a first fastener opening that aligns with the first slot of the junction box;

a second L-shaped bracket, comprising:

a third arm mechanically constrained by the second pair of bracket guides; and a fourth arm, integrally formed with the third arm and oriented at a right angle with respect to the third arm, having a second fastener opening that aligns with the second slot of the junction box;

a first fastener, inserted through the first slot and the first fastener opening, to couple the first L-shaped bracket to the junction box;

a second fastener, inserted through the second slot and the second fastener opening, to couple the second L-shaped bracket to the junction box;

a first external housing disposed on the bottom portion of the frame adjacent to the junction box and coupled to the bottom portion of the frame via the third and fourth slots;

a first conduit having a first end directly coupled to a first feedthrough opening of the junction box formed by the removal of a first knockout of the plurality of knockouts and a second end directly coupled to the first external housing;

a first pair of bar hangers slidably coupled to the first side portion of the frame via the first plurality of hanger bar guides; and a second pair of bar hangers slidably coupled to the second side portion of the frame via the second plurality of hanger bar guides.

30. The lighting apparatus of claim 29, further comprising:

a ballast support bracket having a base portion directly coupled to the bottom portion of the frame and having a platform in parallel alignment with the bottom portion;

a ballast, coupled to the platform of the ballast support bracket, having a second external housing containing a plurality of batteries to supply electrical power to the junction box; and a second conduit having a first end directly coupled to a second feedthrough opening of the junction box formed by the removal of a second knockout of the plurality of knockouts and a second end directly coupled to the second external housing.

* * * * *